US007001006B2

(12) United States Patent
Kanamaru

(10) Patent No.: US 7,001,006 B2
(45) Date of Patent: Feb. 21, 2006

(54) PRINTING APPARATUS AND INK-CONSUMPTION AMOUNT MANAGEMENT METHOD

(75) Inventor: Hiroshi Kanamaru, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/916,595

(22) Filed: Aug. 12, 2004

(65) Prior Publication Data

US 2005/0024398 A1 Feb. 3, 2005

Related U.S. Application Data

(62) Division of application No. 10/400,641, filed on Mar. 28, 2003, now Pat. No. 6,824,236.

(30) Foreign Application Priority Data

Mar. 29, 2002 (JP) ..... 2002-096310

(51) Int. Cl.
*B41J 2/195* (2006.01)

(52) U.S. Cl. ..... 347/7; 347/86; 347/14; 347/19

(58) Field of Classification Search ..... 347/7, 347/37, 86, 19, 14; 702/55
See application file for complete search history.

(56) References Cited

U.S. PATENT DOCUMENTS

| | | | | |
|---|---|---|---|---|
| 4,313,124 | A | 1/1982 | Hara | 346/140 R |
| 4,345,262 | A | 8/1982 | Shirato et al. | 346/140 R |
| 4,459,600 | A | 7/1984 | Sato et al. | 346/140 R |
| 4,463,359 | A | 7/1984 | Ayata et al. | 346/1.1 |
| 4,558,333 | A | 12/1985 | Sugitani et al. | 346/140 R |
| 4,608,577 | A | 8/1986 | Hori | 346/140 R |
| 4,723,129 | A | 2/1988 | Endo et al. | 346/1.1 |
| 4,740,796 | A | 4/1988 | Endo et al. | 346/1.1 |
| 6,247,784 | B1 | 6/2001 | Obana et al. | 347/37 |
| 6,312,073 | B1 | 11/2001 | Inora et al. | 347/7 |
| 6,360,174 | B1 | 3/2002 | Shoki | 702/55 |
| 6,824,236 | B1 * | 11/2004 | Kanamaru | 347/7 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A low-price printing apparatus with excellent operability, capable of accurate residual-ink amount management, and an ink-consumption amount management method for the apparatus. In the printing apparatus, when printing is performed by discharging ink supplied from a replaceable ink tank from a printhead onto a printing medium based on print data received from a host, ink-consumption amount information is stored into a storage medium, then ink consumption is counted, and the ink-consumption amount information stored in the storage medium is updated based on the counted ink consumption amount. On the other hand, occurrence of replacement of ink tank is determined, then the ink-consumption amount information upon determination is stored as first consumption-amount information into the storage medium, then the result of determination is notified to the host, then as a result of notification, the ink amount information of ink contained in an ink tank newly set by replacement of the ink tank is received, and the obtained ink-consumption amount information is updated based on the ink-consumption amount information updated upon reception, the first consumption-amount information stored in the storage medium, and the received ink amount information.

10 Claims, 34 Drawing Sheets

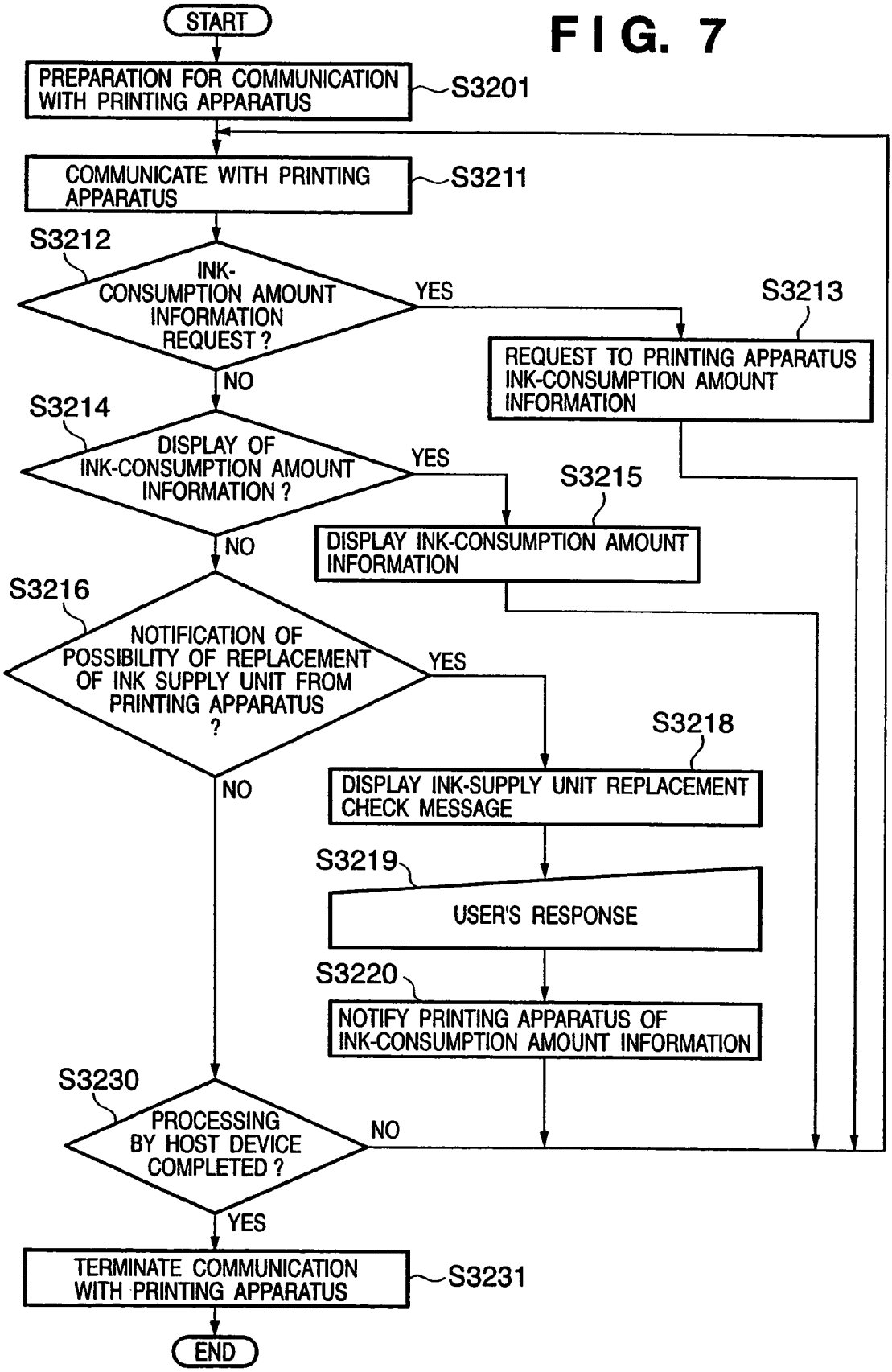
FIG. 7
START
PREPARATION FOR COMMUNICATION WITH PRINTING APPARATUS
S3201
COMMUNICATE WITH PRINTING APPARATUS
S3211
S3212
INK-CONSUMPTION AMOUNT INFORMATION REQUEST ?
YES
S3213
REQUEST TO PRINTING APPARATUS INK-CONSUMPTION AMOUNT INFORMATION
NO
S3214
DISPLAY OF INK-CONSUMPTION AMOUNT INFORMATION ?
YES
S3215
DISPLAY INK-CONSUMPTION AMOUNT INFORMATION
NO
S3216
NOTIFICATION OF POSSIBILITY OF REPLACEMENT OF INK SUPPLY UNIT FROM PRINTING APPARATUS ?
YES
S3218
DISPLAY INK-SUPPLY UNIT REPLACEMENT CHECK MESSAGE
NO
S3219
USER'S RESPONSE
S3220
NOTIFY PRINTING APPARATUS OF INK-CONSUMPTION AMOUNT INFORMATION
S3230
PROCESSING BY HOST DEVICE COMPLETED ?
NO
YES
TERMINATE COMMUNICATION WITH PRINTING APPARATUS
S3231
END

FIG. 8

WHICH INK SUPPLY UNIT REPLACED ?

● COLOR INK SUPPLY UNIT

○ BLACK INK SUPPLY UNIT

○ NOT REPLACED

OK

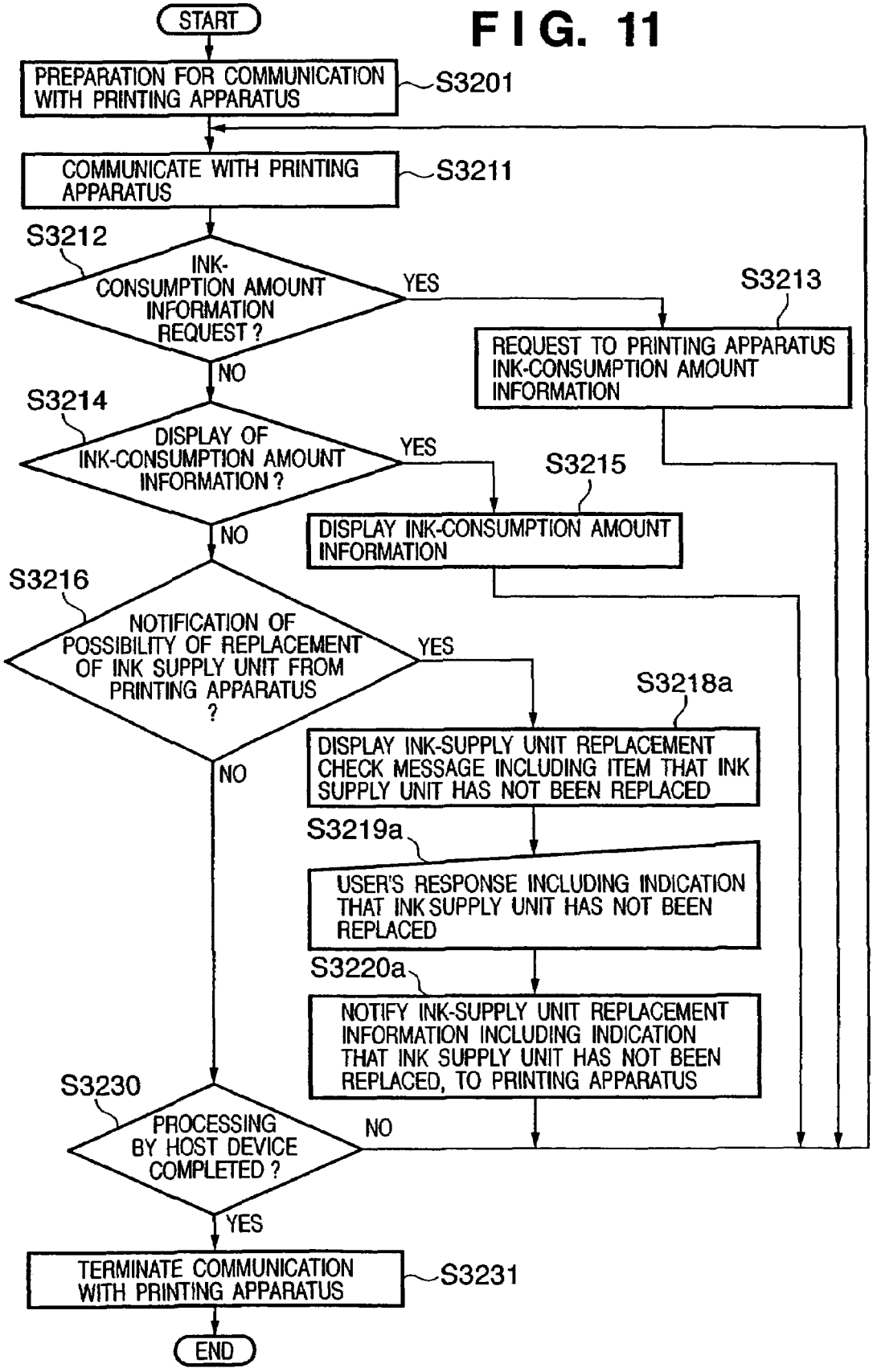
FIG. 11
START
PREPARATION FOR COMMUNICATION WITH PRINTING APPARATUS
S3201
COMMUNICATE WITH PRINTING APPARATUS
S3211
S3212
INK-CONSUMPTION AMOUNT INFORMATION REQUEST ?
YES
S3213
REQUEST TO PRINTING APPARATUS INK-CONSUMPTION AMOUNT INFORMATION
NO
S3214
DISPLAY OF INK-CONSUMPTION AMOUNT INFORMATION ?
YES
S3215
DISPLAY INK-CONSUMPTION AMOUNT INFORMATION
NO
S3216
NOTIFICATION OF POSSIBILITY OF REPLACEMENT OF INK SUPPLY UNIT FROM PRINTING APPARATUS ?
YES
S3218a
DISPLAY INK-SUPPLY UNIT REPLACEMENT CHECK MESSAGE INCLUDING ITEM THAT INK SUPPLY UNIT HAS NOT BEEN REPLACED
NO
S3219a
USER'S RESPONSE INCLUDING INDICATION THAT INK SUPPLY UNIT HAS NOT BEEN REPLACED
S3220a
NOTIFY INK-SUPPLY UNIT REPLACEMENT INFORMATION INCLUDING INDICATION THAT INK SUPPLY UNIT HAS NOT BEEN REPLACED, TO PRINTING APPARATUS
S3230
PROCESSING BY HOST DEVICE COMPLETED ?
NO
YES
TERMINATE COMMUNICATION WITH PRINTING APPARATUS
S3231
END

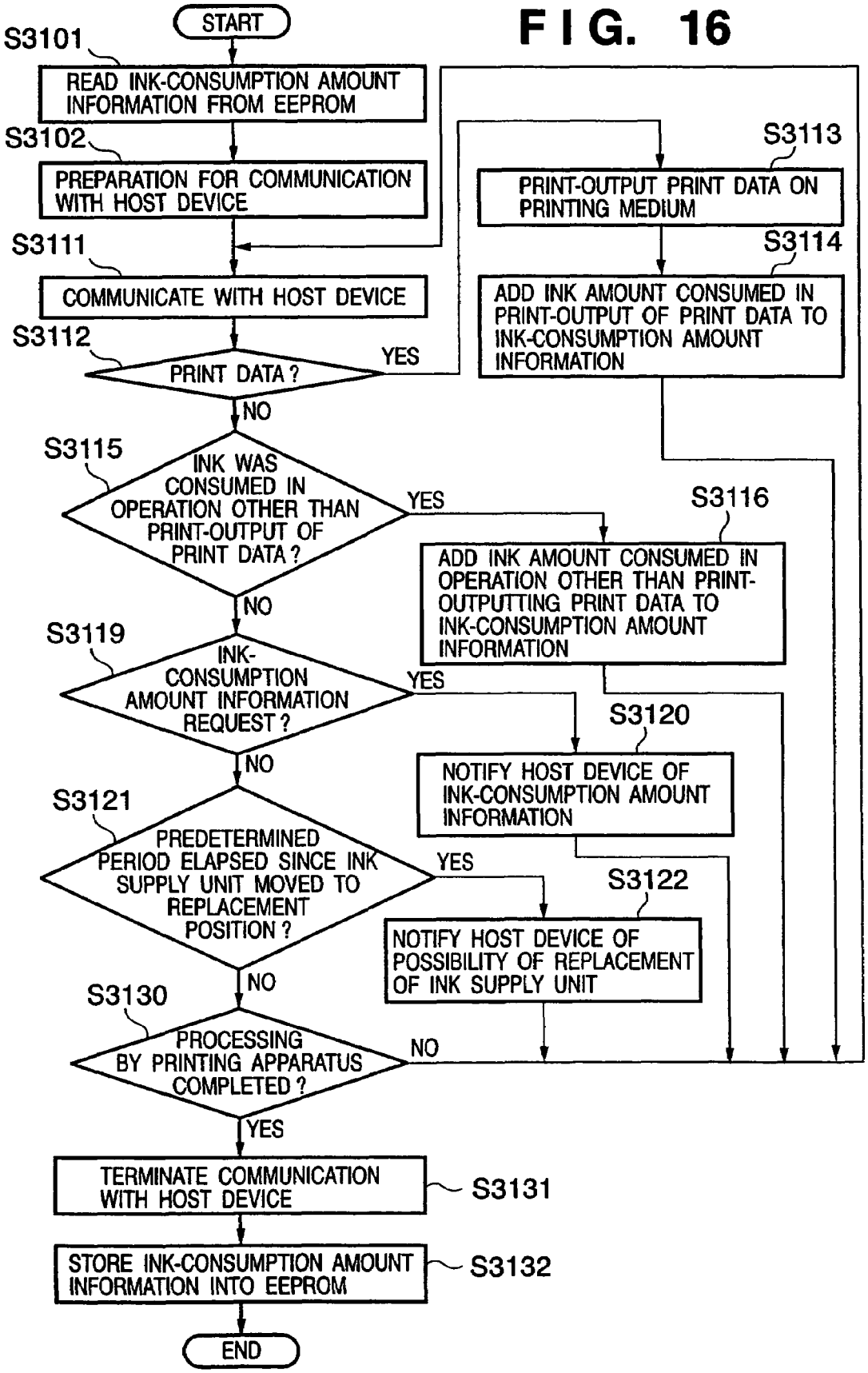
FIG. 16
START
S3101
READ INK-CONSUMPTION AMOUNT INFORMATION FROM EEPROM
S3102
PREPARATION FOR COMMUNICATION WITH HOST DEVICE
S3111
COMMUNICATE WITH HOST DEVICE
S3112
PRINT DATA ?
YES
NO
S3113
PRINT-OUTPUT PRINT DATA ON PRINTING MEDIUM
S3114
ADD INK AMOUNT CONSUMED IN PRINT-OUTPUT OF PRINT DATA TO INK-CONSUMPTION AMOUNT INFORMATION
S3115
INK WAS CONSUMED IN OPERATION OTHER THAN PRINT-OUTPUT OF PRINT DATA ?
YES
NO
S3116
ADD INK AMOUNT CONSUMED IN OPERATION OTHER THAN PRINT-OUTPUTTING PRINT DATA TO INK-CONSUMPTION AMOUNT INFORMATION
S3119
INK-CONSUMPTION AMOUNT INFORMATION REQUEST ?
YES
NO
S3120
NOTIFY HOST DEVICE OF INK-CONSUMPTION AMOUNT INFORMATION
S3121
PREDETERMINED PERIOD ELAPSED SINCE INK SUPPLY UNIT MOVED TO REPLACEMENT POSITION ?
YES
NO
S3122
NOTIFY HOST DEVICE OF POSSIBILITY OF REPLACEMENT OF INK SUPPLY UNIT
S3130
PROCESSING BY PRINTING APPARATUS COMPLETED ?
NO
YES
TERMINATE COMMUNICATION WITH HOST DEVICE
S3131
STORE INK-CONSUMPTION AMOUNT INFORMATION INTO EEPROM
S3132
END

PRINTING APPARATUS AND INK-CONSUMPTION AMOUNT MANAGEMENT METHOD

This application is a division of application Ser. No. 10/400,641, filed Mar. 28, 2003, issued as U.S. Pat. No. 6,824,236, the contents of which are incorporated herein by reference.

CLAIM OF PRIORITY

This application claims priority from Japanese Patent Application No. 2002-096310, entitled "printing apparatus and a management method of an ink consumption amount", which is incorporated herein by reference.

FIELD OF THE INVENTION

The present invention relates to a printing apparatus and an ink-consumption amount management method and, more particularly, to a printing apparatus which performs printing on a printing medium by using an inkjet printhead supplied with ink from an ink tank, and an ink-consumption amount management method.

BACKGROUND OF THE INVENTION

Conventional inkjet printing apparatuses (hereinbelow simply referred to as "printing apparatuses") perform printing on a printing medium while consuming ink supplied from an ink supply unit. When ink has been exhausted from the ink supply unit, many of the inkjet printing apparatuses continue printing on the printing medium without notifying a user of the ink exhausted status even if printing is not normally performed. Recently, however, an increasing number of printing apparatuses notify a user of an ink exhausted status if the ink has been exhausted, and urge the user to replace the ink supply unit.

As a residual-ink amount management system to detect exhaustion of ink from ink supply unit, the following systems are known.

(1) Ink-consumption amount information is counted every time ink is consumed and the information is stored in a memory. When a count value becomes a value indicating an assumed ink exhausted status, a user is notified of the status and urged to replace the ink supply unit. Then the user replaces the ink supply unit, and the user himself/herself voluntarily sets the printing apparatus to an ink-filled status.

(2) Ink-consumption amount information is counted every time ink is consumed and the information is stored in a memory. When a count value becomes a value indicating an assumed ink exhausted status, a user is notified of the status and urged to replace the ink supply unit. On the other hand, the replacement of ink supply unit is automatically detected, and the apparatus is set to an ink-filled status.

(3) Physical ink present/absent status is detected, and when the ink has been exhausted, a user is notified of the ink exhaustion and urged to replace the ink supply unit. Then, when the ink supply unit has been replaced and the presence of ink is detected, the apparatus is automatically set to an ink-filled status.

However, the above-described conventional residual-ink amount management systems have the following problems. The problems will be described in correspondence with the above systems (1) to (3).

System (1)

In this system, in a case where the ink supply unit has been replaced, since the user himself/herself voluntarily sets the apparatus to the ink-filled status, if the user forgets the operation, the residual-ink amount management cannot be properly performed. Further, even though the user does not forget the operation, it is considerably troublesome for the user to voluntarily set the apparatus to the ink-filled status.

Further, in this system, as the amount of ink consumed during a period from the point where the user replaced the ink supply unit to the point where the user voluntarily sets the apparatus to the ink-filled status is not considered, this ink-consumption amount becomes an error in the ink-tank residual amount management.

Further, if the amount of ink in the new ink supply unit is different from an assumed amount upon replacement of ink supply unit, the accuracy of the residual-ink amount management is further deteriorated.

System (2)

In this system, the replacement of ink supply unit can be automatically detected, however, it is not determined that the ink status has actually become a predetermined status. If the amount of ink in the new ink supply unit is different from an assumed amount upon replacement of ink supply unit, the accuracy of the residual-ink amount management is deteriorated.

System (3)

This system is excellent as a residual-ink amount management system, however, to detect the physical ink present/absent status, an expensive residual-ink amount sensor is required. Thus the system itself is expensive.

SUMMARY OF THE INVENTION

Accordingly, it is an object of the present invention to provide a low-price printing apparatus and an ink-consumption amount management method for realizing excellent operability and accurate management of residual ink amount.

According to one aspect of the present invention, the foregoing object is attained by providing a printing apparatus for performing printing by discharging ink supplied from a replaceable ink tank on a printing medium, based on print data received from a host, comprising: storage means for storing ink-consumption amount information; count means for counting consumption of the ink; update means for updating the ink-consumption amount information stored in the storage means based on an ink consumption amount counted by the count means; determination means for determining occurrence of replacement of the ink tank; storage control means for performing control on storing the ink-consumption amount information upon determination by the determination means, as first consumption-amount information, into the storage means; notification means for notifying the host of the result of determination by the determination means; reception means for receiving ink amount information on ink contained in an ink tank newly set by the replacement of the ink tank, as the result of notification by the notification means, from the host; and change means for changing the ink-consumption amount information obtained by the update means, based on the ink-consumption amount information updated by the update means upon reception by the reception means, the first consumption-amount information stored in the storage means, and the ink amount information received by the reception means.

It may be arranged such that the determination means includes: measurement means for measuring elapsed time since the ink tank moved to a replacement position; and comparison means for comparing the elapsed time measured by the measurement means with a predetermined threshold value, and the determination means determines the occurrence of replacement of the ink tank based on the result of comparison by the comparison means.

Alternatively, it may be arranged such that the determination means includes a sensor that detects attachment/removal of the ink tank, and determines the occurrence of replacement of the ink tank based on an output from the sensor.

Note that the threshold value is variable.

Further, it is preferable that the host includes: display means for displaying an ink-tank replacement check message on a display screen, based on the result of determination notified by the notification means; receiving means for receiving confirmation of replacement of the ink tank from a user; and transmission means for transmitting the ink amount information on the ink contained in the ink tank newly set by the replacement of the ink tank, based on reception of the confirmation of replacement of the ink tank, to the apparatus.

Further, it may be arranged such that the host further includes designation means for designating an amount of ink contained in the ink tank newly set by the replacement of the ink tank.

In addition, it is preferable that the display means is capable of displaying a message for checking to be sure that no ink tank has been replaced, and the receiving means is capable of receiving confirmation that no ink tank has been replaced.

Further, it is preferable in the above construction that the apparatus further comprises prevention means for preventing change of the ink-consumption amount information by the change means if the receiving means receives the confirmation that no ink tank has been replaced and it is confirmed via the reception means that no ink tank has been replaced.

It is preferable that the count means includes: first count means for counting ink consumption related to a printing operation based on the print data from the host; and second count means for counting the ink consumption not related to the printing operation.

Further, it is preferable that the apparatus further comprises: presumption means for presuming that the replacement of the ink tank has been made upon acquisition of the result of determination by the determination means; and accumulation means for accumulating the ink consumption obtained from counting by the first or second count means since presumption of the replacement of the ink tank by the presumption means, as the ink consumption from the ink tank newly set by the replacement of the ink tank.

Note that it is preferable that the printhead is an inkjet printhead, and the inkjet printhead has electrothermal transducers that generate thermal energy to be applied to ink, so as to discharge the ink by utilizing the thermal energy.

According to another aspect of the present invention, the foregoing object is attained by providing a printing apparatus for performing printing by discharging ink supplied from a replaceable ink tank on a printing medium, based on print data received from a host, comprising: storage means for storing ink-consumption amount information; count means for counting consumption of the ink; update means for updating the ink-consumption amount information stored in the storage means based on an ink consumption amount counted by the count means; determination means for determining a possibility of occurrence of replacement of the ink tank; notification means for notifying the host of a result of determination by the determination means; reception means for receiving ink amount information on ink contained in an ink tank newly set by the replacement of the ink tank, from the host; and change means for changing the ink-consumption amount information obtained by the update means, based on the ink amount information received by the reception means.

According to still another aspect of the present invention, the foregoing object is attained by providing a printing apparatus for performing printing by discharging ink supplied from a replaceable ink tank on a printing medium, based on print data received from a host, comprising: storage means for storing ink-consumption amount information; count means for counting consumption of the ink; update means for updating the ink-consumption amount information stored in the storage means based on an ink consumption amount counted by the count means; determination means for determining occurrence of replacement of the ink tank; and change means for changing the ink-consumption amount information obtained by the update means, based on a result of determination by the determination means.

According to still another aspect of the present invention, the foregoing object is attained by providing an ink-consumption amount management method for a printing apparatus for performing printing by discharging ink supplied from a replaceable ink tank on a printing medium, based on print data received from a host, the method comprising: a storage step of storing ink-consumption amount information into a storage medium; a count step of counting consumption of the ink; an update step of updating the ink-consumption amount information stored in the storage medium based on an ink consumption amount counted at the count step; a determination step of determining occurrence of replacement of the ink tank; a storage control step of performing control on storing the ink-consumption amount information upon determination at the determination step, as first consumption-amount information, into the storage medium; a notification step of notifying the host of a result of determination at the determination step; a reception step of receiving ink amount information on the ink contained in an ink tank newly set by the replacement of the ink tank, as the result of notification at the notification step, from the host; and a change step of changing the ink-consumption amount information obtained at the update step, based on the ink-consumption amount information updated at the update step upon reception at the reception step, the first consumption-amount information stored in the storage medium, and the ink amount information received at the reception step.

According to still another aspect of the present invention, the foregoing object is attained by providing an ink-consumption amount management method for a printing apparatus for performing printing by discharging ink supplied from a replaceable ink tank on a printing medium, based on print data received from a host, the method comprising: a storage step of storing ink-consumption amount information into a storage medium; a count step of counting consumption of the ink; an update step of updating the ink-consumption amount information stored in the storage medium based on an ink consumption amount counted at the count step; a determination step of determining a possibility of occurrence of replacement of the ink tank; a notification step of notifying the host of a result of determination at the determination step; a reception step of receiving ink amount information on ink contained in an ink tank newly set by the replacement of the ink tank, as a result of notification at the notification step, from the host; and a change step of changing the ink-consumption amount information obtained at the update step, based on the ink amount information received at the reception step.

According to still another aspect of the present invention, the foregoing object is attained by providing an ink-consumption amount management method for a printing apparatus for performing printing by discharging ink supplied from a replaceable ink tank on a printing medium, based on print data received from a host, the method comprising: a storage step of storing ink-consumption amount information into a storage medium; a count step of counting consumption of the ink; an update step of updating the ink-consumption amount information stored in the storage medium based on an ink consumption amount counted at the count step; a determination step of determining occurrence of replacement of the ink tank; and a change step of changing the ink-consumption amount information obtained at the update step, based on a result of determination at the determination step.

The invention is particularly advantageous since the replacement of an ink tank is automatically determined and notified to the host, and the ink-consumption amount information is updated based on new ink amount information received as a result of the notification, the ink consumption amount upon the determination of replacement of the ink tank, and the ink consumption amount upon reception of the new ink amount information, the amount of ink consumed during a period from the point where the user replaced the ink tank to the point where the ink-consumption amount information is actually updated is considered, and consequently the ink-consumption amount management can be more accurately performed with a simple construction.

Further, the invention is advantageous since the user can easily replace the ink-consumption amount information to an optimum value by input in accordance with a displayed message. As a result, the user can be prevented from forgetting to replace the ink-consumption amount information. Furthermore, a response including information about a status where the ink tank has not been replaced can be made in accordance with a displayed message, the user's erroneous operation can be prevented.

Moreover, the ink-consumption amount information can be updated to a value in consideration of residual ink amount in the newly replaced ink tank, even if an ink tank which is not a new but a partially-used ink tank is employed, accurate ink-consumption amount management can be performed.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 is a flowchart showing the operation of a host device according to the first embodiment of the present invention;

FIGS. 8 and 9 are examples of the ink-supply unit replacement check message according to a second embodiment of the present invention;

FIG. 11 is a flowchart showing the operation of the host device according to the second embodiment of the present invention;

FIG. 16 is flowchart showing the operation of the printing apparatus according to a seventh embodiment of the present invention;

DETAILED DESCRIPTION OF THE PREFERRED EMBODIMENTS

Preferred embodiments of the present invention will now be described in detail in accordance with the accompanying drawings.

The following embodiments exemplify a printing apparatus which employs an inkjet printhead.

In this specification, "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, a "printing medium" not only includes a paper sheet used in common printing apparatuses, but also broadly includes materials, such as cloth, a plastic film, a metal plate, glass, ceramics, wood, and leather, capable of accepting ink.

Furthermore, "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

<First Embodiment (FIGS. 1–7)>

Figure 1:
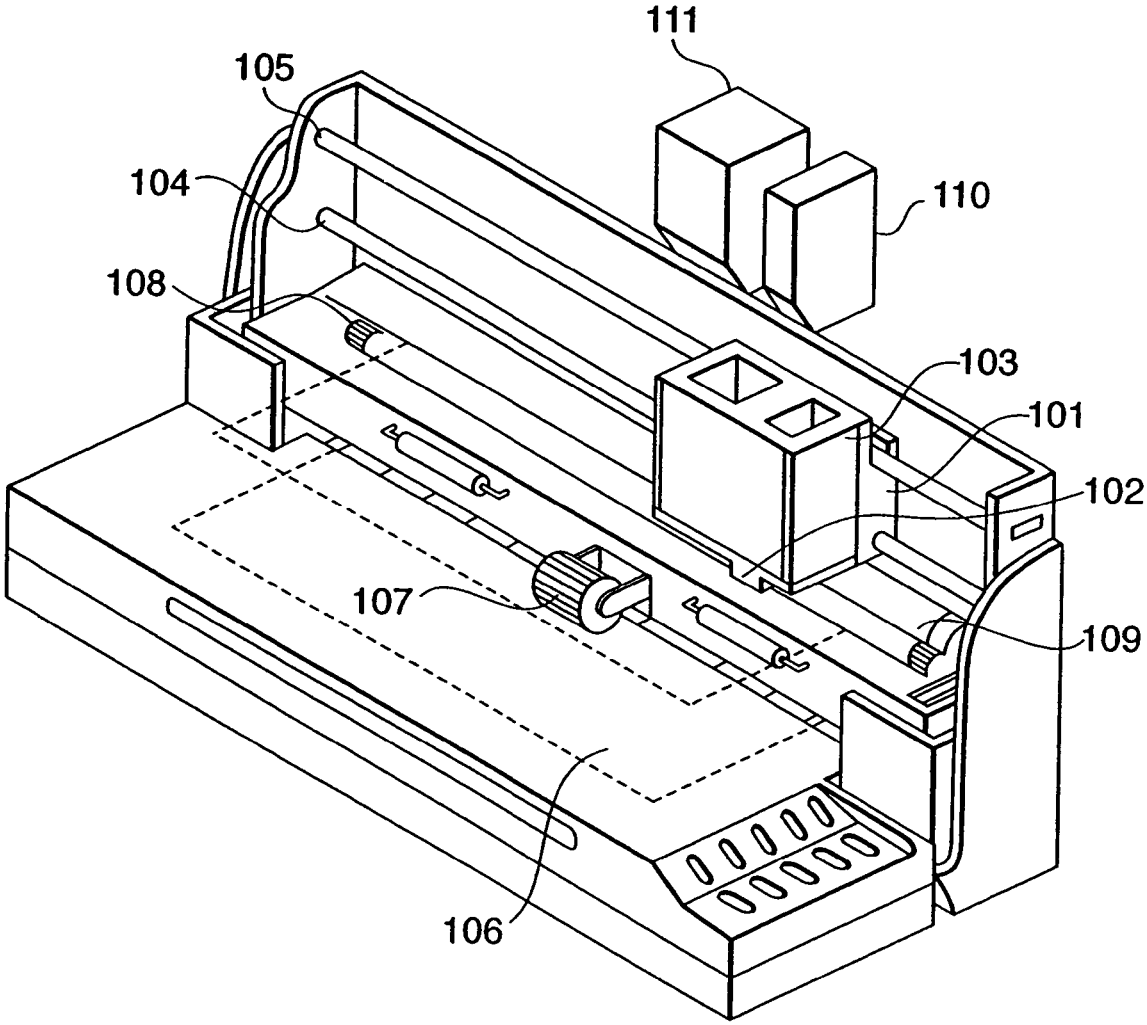
FIG. 1 is a perspective view showing the structure of an inkjet printing apparatus as a typical embodiment of the present invention.

FIG. 1 is a perspective view showing the entire structure of an inkjet printing apparatus (hereinbelow referred to as a "printing apparatus") as a typical embodiment of the present invention.

As shown in FIG. 1, a carriage 101 carrying a printhead 102 and a cartridge guide 103 is scanned along guide shafts 104 and 105. A printing medium 106 is fed into the apparatus main body by a paper-feed roller 107, and transferred, while being held by a paper-conveyance roller 108, a pinch roller (not shown) and a paper-pressing plate 109, to a position in front of the printhead 102. Then printing is performed on the printing medium 106 with ink discharged from the printhead 102.

A color ink supply unit (ink tank or an ink cartridge) 110 containing yellow, magenta and cyan color inks and a black ink supply unit (ink tank or ink cartridge) 111 containing black ink are respectively inserted into the cartridge guide 103 and communicably connected with the printhead 102.

Figure 2A:
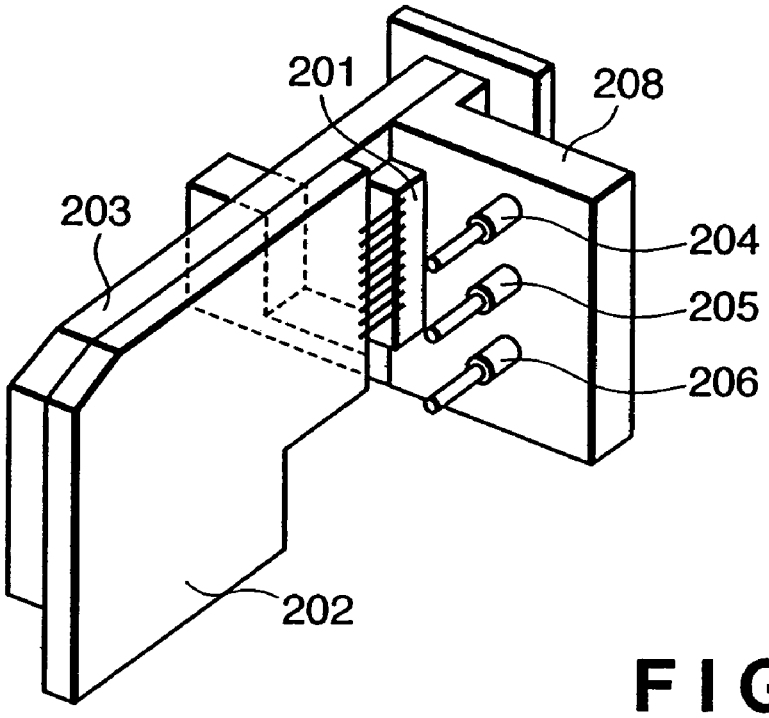
FIGS. 2A and 2B are perspective views showing the structure of a printhead.
Figure 2B:
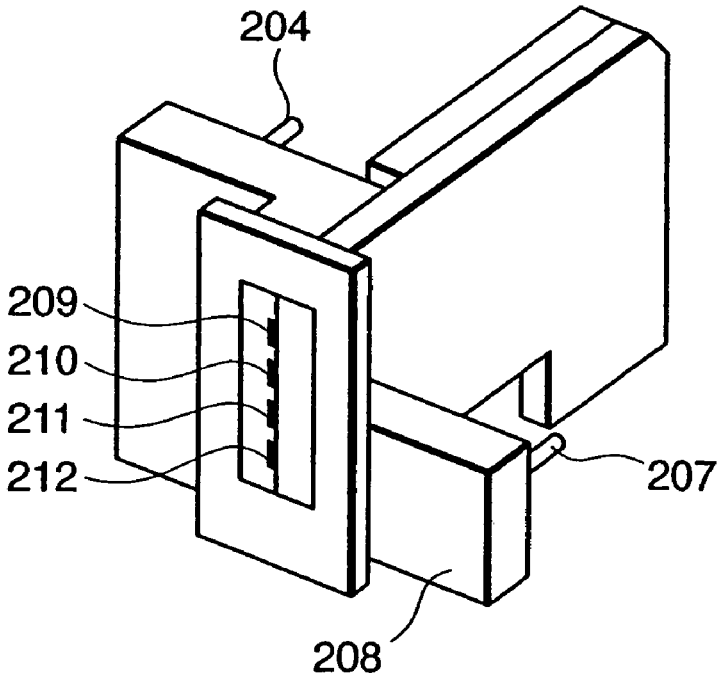

FIGS. 2A and 2B are perspective views showing the structure of the printhead 102 to be mounted on the printing apparatus in FIG. 1.

As shown in FIG. 2B, yellow, magenta, cyan and black ink discharge orifice groups 209 to 212 are arrayed in a straight line in a front part of the printhead 102. In this example, the yellow, magenta and cyan discharge orifice groups respectively have 24 discharge orifices, and the black discharge group has 64 discharge orifices. The discharge orifice groups are arrayed with a pitch equal to or greater than a nozzle pitch. The discharge orifices are respectively provided with ink channels communicated with the orifices, and a common liquid chamber (not shown) to supply ink to the respective ink channels is provided in a rear portion of the ink channels.

The ink channels corresponding to the respective discharge orifices are provided with electrothermal transducers to generate thermal energy utilized for discharging ink droplets from the discharge orifices and electrode wires to provide electric power to the electrothermal transducers. The electrothermal transducers and the electrode wires are formed on a substrate 201 made of silicon or the like by a film forming technique. Further, partition walls, a top plate and the like made of resin, glass material or the like are deposited on the substrate 201, thereby the above-described discharge orifices, the ink channels and the common liquid chambers are formed. In the rear of the substrate 201, a driving circuit to drive the electrothermal transducers based on a print signal is provided as a print substrate 202.

Further, as shown in FIGS. 2A and 2B, the substrate 201 and the print substrate 202 are fixed to an aluminum plate 203. The ink cartridges 110 and 111 (See FIG. 1) are inserted approximately along the aluminum plate 203 into the cartridge guide 103 (See FIG. 1), and connected to pipes 204 to 207 projected along the aluminum plate 203.

The pipe 204 is provided for the yellow ink; the pipe 205, for the magenta ink; the pipe 206, for the cyan ink; and the pipe 207, for the black ink. The pipes 204 to 207 are protruded from a plastic member (also referred to as a "distributor") 208 extending in a direction orthogonal to the substrate, and the pipes 204 to 207 are communicated with the common liquid chambers of the corresponding discharge orifice groups (yellow, magenta, cyan and black) through the channels in the plastic member 208.

Figure 3:
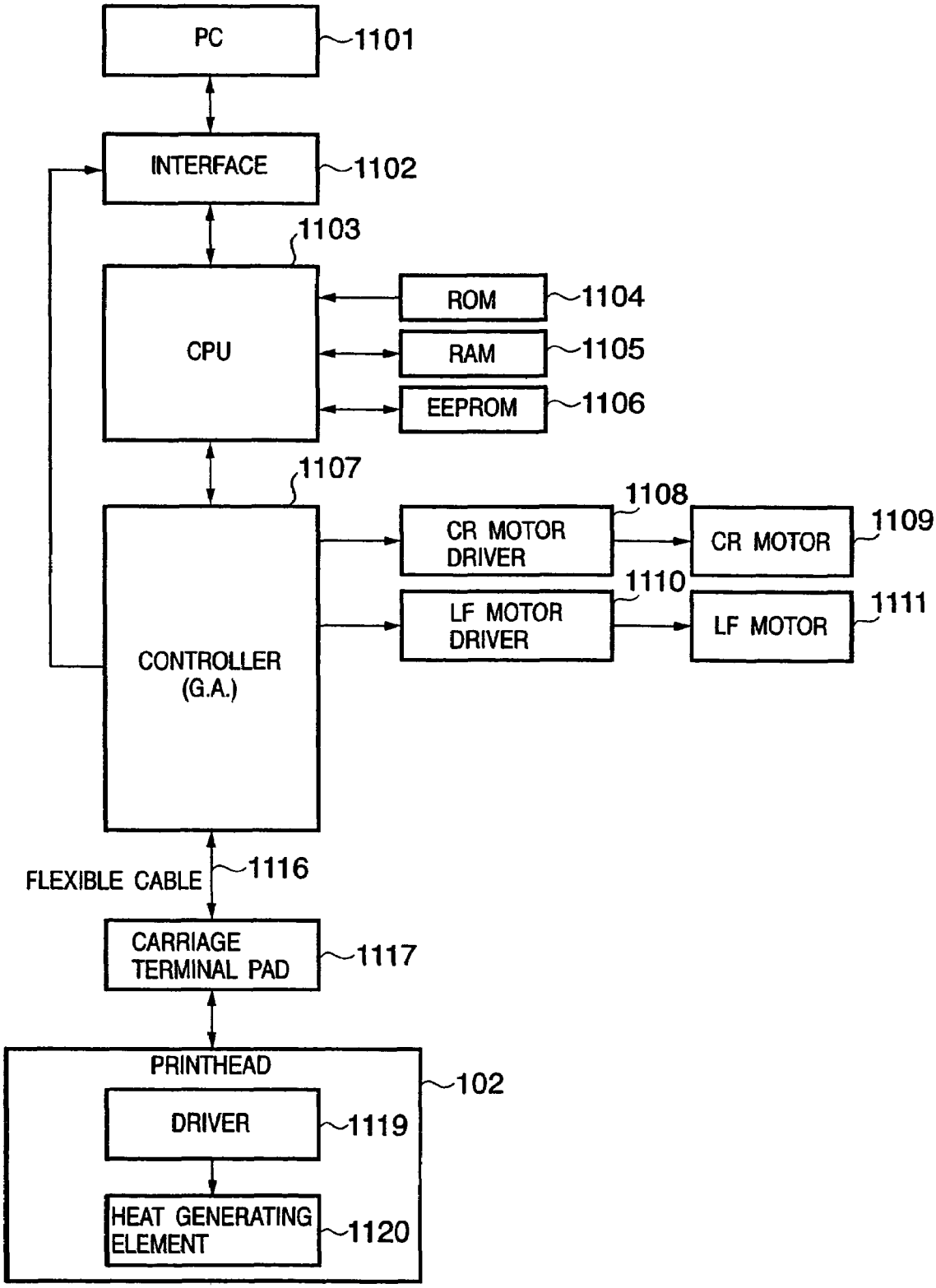
FIG. 3 is a block diagram showing a control construction of the printing apparatus in FIG. 1.

FIG. 3 is a block diagram showing the control construction of the printing apparatus in FIG. 1.

In FIG. 3, numeral 1101 denotes a PC (personal computer), referred to as a host device (or host) hereinafter, which transmits print data to the printing apparatus; 1102, an interface (I/F) which receives the print data from the host device; 1103, a CPU; 1104, a ROM; 1105, a RAM; and 1106, an EEPROM.

Further, numeral 1107 denotes a controller (G.A.) comprising a custom IC (gate array) which controls the I/F, a CR motor, an LF motor, a printing medium sensor (not shown) and the printhead. Numeral 1108 denotes a CR motor driver which controls the CR motor; 1109, the CR motor; 1110, an LF motor driver which drives an LF motor; and 1111, the LF motor.

Further, numeral 1116 denotes a flexible cable connecting the printhead 102 with the carriage 101; 1117, a carriage terminal pad forming an electrical connection point with the printhead 102; 1119, a driver of the printhead 102; and 1120, a heat generating element of the printhead 102.

The printhead 102 performs printing by scanning of the carriage 101 holding the printhead by the CR motor 1109 and discharging ink onto a printing medium in accordance with print data.

Figure 4:
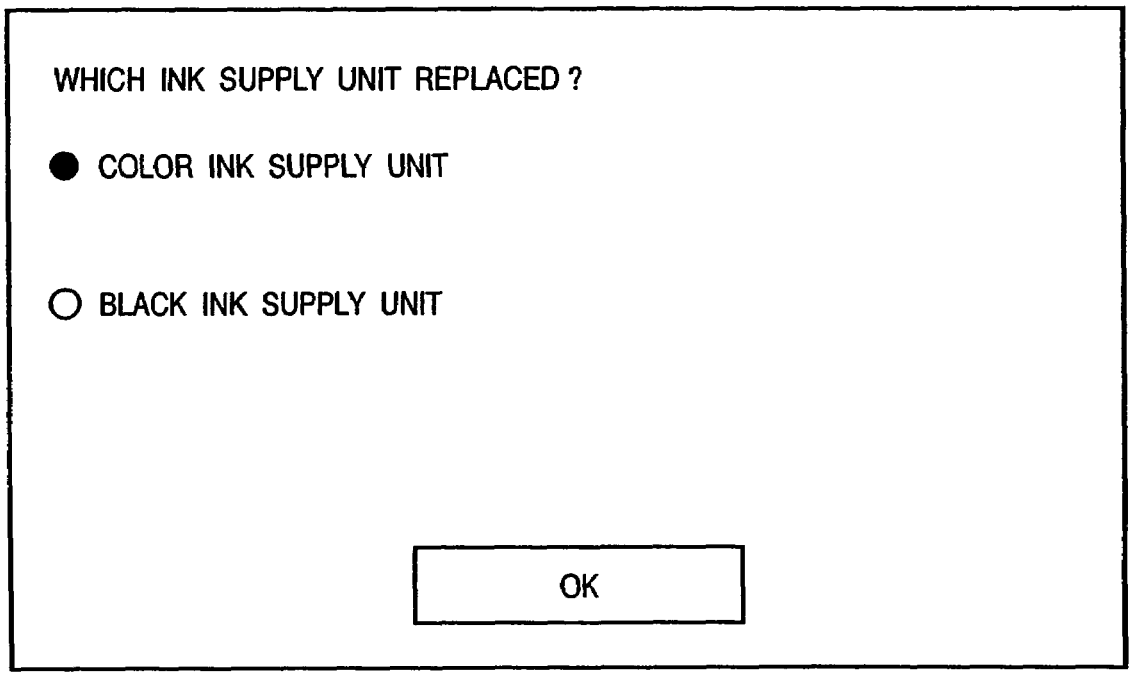
FIGS. 4 and 5 are examples of an ink-supply unit replacement check message according to a first embodiment of the present invention.

FIG. 4 is an example of an ink-supply unit replacement check message.

As will be described later in detail, when the printing apparatus determines that there is a possibility that a user has replaced an ink supply unit and notifies the host of the possibility, this message is displayed on a display screen by the host device in response to the notification. When the message is displayed, the user can notify the host device 1101 of the replacement of an ink supply unit by using a man-machine interface.

Further, in accordance with the displayed message, the user designates the replaced ink supply unit.

That is, if the color ink supply unit has been replaced, the user selects "color ink supply unit", while if the black ink supply unit has been replaced, the user selects "black ink supply unit". If the color ink supply unit and the black ink supply unit have been replaced, the user selects "color ink supply unit" and "black ink supply unit".

When the selection has been made, the use selects "OK" and terminates confirmation of the replacement of ink supply unit.

Figure 5:
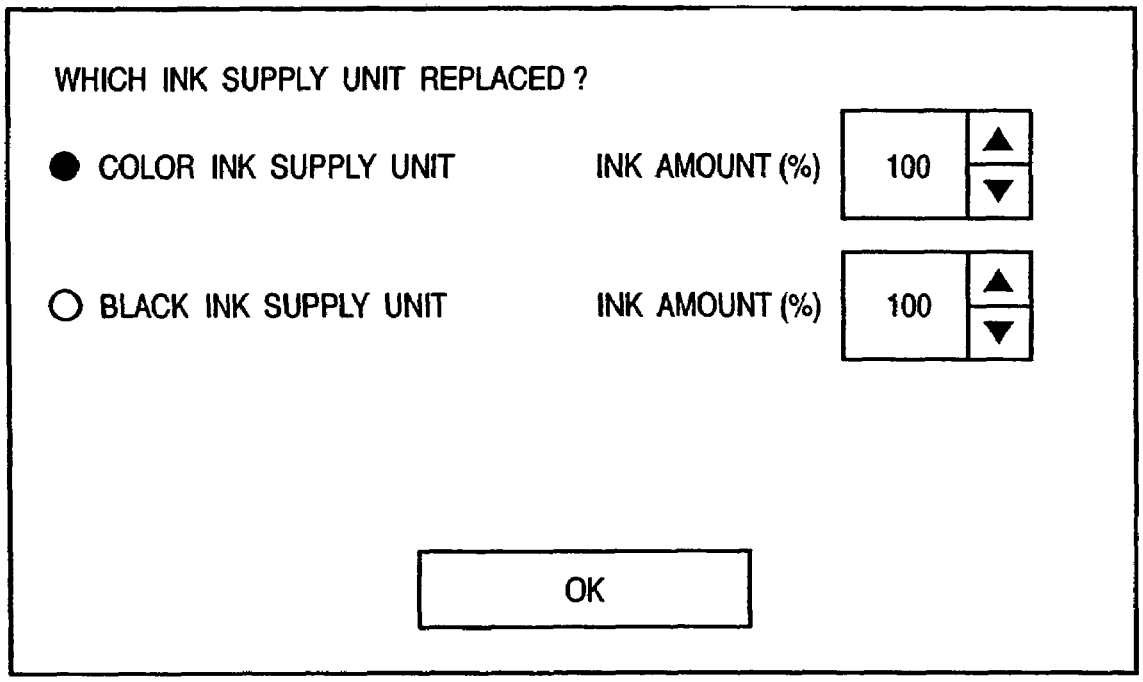

FIG. 5 is another example of the ink supply unit replacement check message.

This message is also displayed for a similar reason to that described in FIG. 4. Accordingly, when the message is displayed, the user can notify the host device 1101 of the replacement of an ink supply unit by using a man-machine interface.

In accordance with the displayed message, the user inputs the following designation regarding the replaced ink supply unit.

That is, if the color ink supply unit has been replaced, the user selects "color ink supply unit", while if the black ink supply unit has been replaced, the user selects "black ink supply unit". If the color ink supply unit and the black ink supply unit have been replaced, the user selects "color ink supply unit" and "black ink supply unit". In addition to the above, the user inputs the amount of ink in the newly-set ink supply unit. If the ink supply unit has been replaced with a brandnew ink supply unit, the user inputs "100%" (default). If the ink supply unit has been replaced with a partially-used ink supply unit, the user inputs an arbitrary value from 1 to 99%. When the selection and input have been completed, the user selects "OK" and terminates the confirmation of the replacement of the ink supply unit.

Figure 6A:
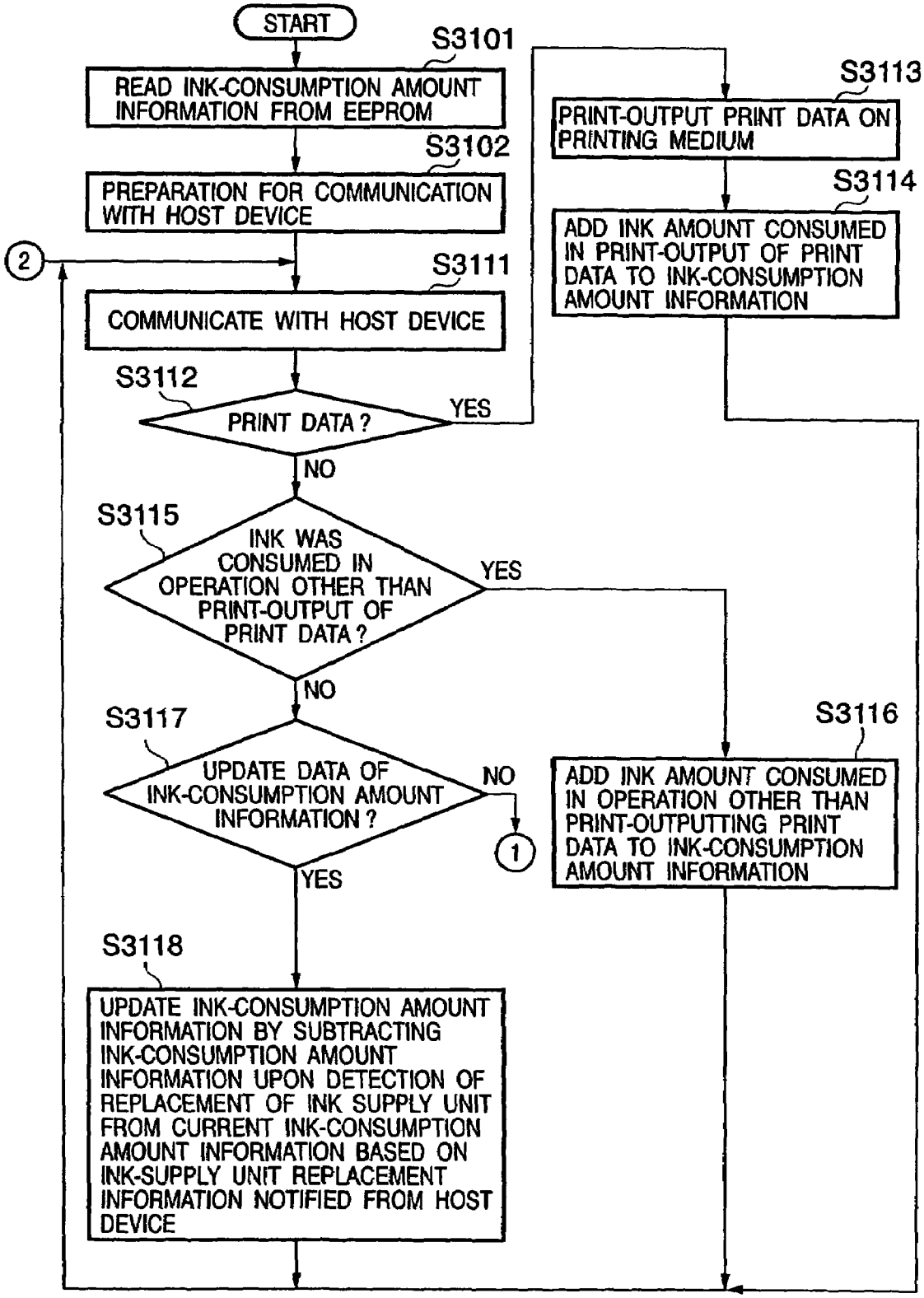
FIGS. 6A and 6B are flowcharts showing the operation of the printing apparatus according to the first embodiment of the present invention.
Figure 6B:
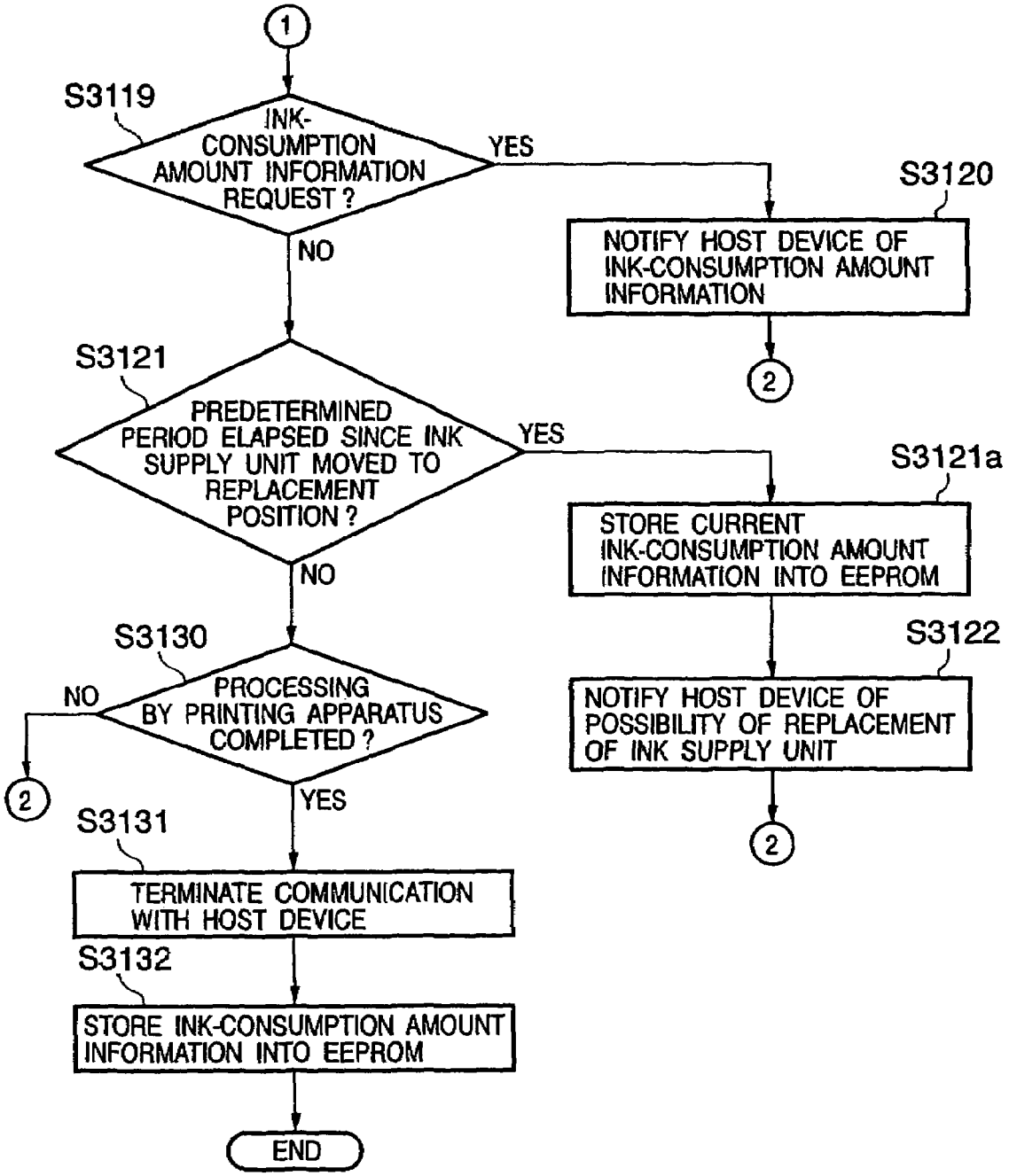

FIGS. 6A and 6B are flowcharts showing the operation of the printing apparatus according to a first embodiment of the present invention.

First, at step S3101, an ink consumption amount (ink-consumption amount information) is read from the EEPROM 1106, then at step S3102, preparation for communication with the host device 1101 is made. At step S3111, communication is performed with the host device 1101, and at step S3112, it is determined whether or not data received from the host device 1101 is print data.

If it is determined that the received data is print data, the process proceeds to step S3113 at which the print data is print-outputted onto a printing medium. Next, at step S3114, the amount of ink consumed in printing using the print data is added to the ink consumption amount read from the EEPROM 1106. The amount obtained from the addition becomes a current ink consumption amount ($X_{CRNT}$). Thereafter, the process returns to step S3111.

On the other hand, if it is determined that the received data is not print data, the process proceeds to step S3115, at which it is determined whether or not the ink has been consumed in an operation (e.g., preliminary discharge, suction recovery and the like) other than the printing based on print data. If it is determined that the ink has been consumed in the operation other than the printing based on print data, the process proceeds to step S3116, at which the amount of ink consumed in the operation other than the printing based on print data is added to the ink consumption amount read from the EEPROM 1106. The amount obtained from the addition becomes the current ink consumption amount ($X_{CRNT}$) Thereafter, the process returns to step S3111.

On the other hand, if it is determined at step S3115 that the ink has not been consumed in an operation other than the print-output of print data, the process proceeds to step S3117, at which it is determined whether or not the received data is update data of the ink-consumption amount information (e.g., data generated upon update of ink amount in the replaced ink tank in the selection and input processing described in connection with FIGS. 4 and 5). If it is determined that the received data is update data of the ink-consumption amount information ($X_{UPDT}$), the process proceeds to step S3118, at which the ink-consumption amount information is updated with a value obtained by adding the difference ($X_{CRN}-X_{CHG}$), obtained by subtracting the ink-consumption amount information ($X_{CHG}$) upon detection of replacement of an ink supply unit from the current ink-consumption amount information ($X_{CRNT}$), to the update data ($X_{UPDT}$) of the ink-consumption amount information indicated by ink-supply unit replacement information notified from the host device 1101. Thereafter the process returns to step S3111.

By this processing, the amount of ink consumed from the point where the ink supply unit was replaced to the point where the update data of the ink-consumption amount information has been received is considered.

On the other hand, if it is determined at step S3117 that the received data is not update data of the ink-consumption amount information, the process proceeds to step S3119, at which it is determined whether or not the received data is an ink-consumption amount information request. If it is determined that the received data is an ink-consumption amount information request, the process proceeds to step S3120, at which the ink-consumption amount information read from the EEPROM 1106 is notified to the host device 1101. Thereafter, the process returns to step S3111.

On the other hand, if it is determined at step S3119 that the received data is not an ink-consumption amount information request, the process proceeds to step S3121, at which it is determined whether or not a predetermined period has elapsed since the ink-supply unit moved to a replacement position. If it is determined that the predetermined period has elapsed since the ink supply unit moved to the replacement position, the process proceeds to step S3121*a*, at which the current ink-consumption amount information is stored into the EEPROM 1106 (the ink-consumption amount information stored at this time is $X_{CHG}$), further, at step S3122, the host device 1101 is notified of the possibility of replacement of an ink supply unit. Thereafter, the process returns to step S3111.

On the other hand, if it is determined at step S3121 that the predetermined period has not elapsed since the ink supply unit moved to the replacement position, the process proceeds to step S3130, at which it is determined whether or not the received data indicates an instruction to terminate processing by the printing apparatus. If it is determined that the received data indicates an instruction to terminate the processing by the printing apparatus, the process proceeds to step S3131, at which the communication with the host device is terminated. On the other hand, if it is determined that the received data does not indicate an instruction to terminate the processing by the printing apparatus, the process returns to step S3111.

Finally, at step S3132, the ink-consumption amount information at that time is stored into the EEPROM 1106, and the processing by the printing apparatus ends.

Next, the operation on the host device side will be described.

FIG. 7 is a flowchart showing the operation of the host device according to the first embodiment of the present invention.

First, at step S3201, preparation for communication with the printing apparatus is made. At step S3211, communication is performed with the printing apparatus.

Further, at step S3212, it is determined whether or not the content of the communication with the printing apparatus is an ink-consumption amount information request. If the content of the communication is an ink-consumption amount information request, the process proceeds to step S3213, at which the host device requests the printing apparatus to send the ink-consumption amount information. Thereafter, the process returns to step S3211.

On the other hand, if it is determined at step S3212 that the content of the communication is not an ink-consumption amount information request, the process proceeds to step S3214, at which it is determined whether or not the content of processing in the host device is display of ink-consumption amount information. If the content of the processing is display of ink-consumption amount information, the process proceeds to step S3215, at which the ink-consumption amount information is displayed on the display unit (e.g., a CRT, an LCD, a PDP and FED) of the host device. The display at this time is made based on the ink-consumption amount information notified from the printing apparatus at step S3120 in FIGS. 6A and 6B. Thereafter, the process returns to step S3211.

On the other hand, if it is determined at step S3214 that the content of the processing is not display of ink-consumption amount information, the process proceeds to step S3216, at which it is determined whether or not there is notification of a possibility of replacement of an ink supply unit from the printing apparatus. The determination is made by examining whether or not the notification from the printing apparatus has been made by the process at step S3122 in FIGS. 6A and 6B. If it is determined that there is notification of a possibility of replacement of an ink supply unit from the printing apparatus, the process proceeds to step S3218, at which the ink-supply unit replacement check message as shown in FIG. 4 or FIG. 5 is displayed.

Thereafter, the process waits for a response from the user, and at step S3219, the user makes a response in accordance with the displayed ink-supply unit replacement check message. Further, at step S3220, the ink-consumption amount information is generated from the content of the user's response, and the ink-consumption amount information of the replaced ink supply unit is notified to the printing apparatus. For example, if the response is made to the message as shown in FIG. 4, the ink-consumption amount information is 100% (or the predefined default value), while if the response is made to the message as shown in FIG. 5, the value of a percentage (%) designated by the user corresponds to the ink-consumption amount information. Thereafter, the process returns to step S3211.

On the other hand, if it is determined at step S3216 that there is not notification of a possibility of replacement of an ink supply unit from the printing apparatus, the process proceeds to step S3230, at which it is determined whether or not an instruction to terminate the processing by the host device has been made. If it is determined that an instruction to terminate the processing by the host device has been made, the process proceeds to step S3231, at which the communication with the printing apparatus is terminated, and the processing by the host device ends. On the other hand, if it is determined that an instruction to terminate the processing by the host device has not been made, the process returns to step S3211.

As described above, according to the present embodiment, the printing apparatus detects that the user has replaced an ink supply unit and notifies the host device of the replacement of the ink supply unit, while the host device displays the ink-supply unit replacement check message, thereby urges the user to input proper ink-supply unit replacement information. As the ink-supply unit replacement information inputted by the user is notified from the host device to the printing apparatus, the ink-consumption amount information held in the printing apparatus can be updated to optimum information.

Further, in a case where the ink-consumption amount information is stored in a storage medium (e.g., a nonvolatile memory such as an EEPROM, an FeRAM or an MRAM), and the ink-consumption amount information is updated based on information notified from the host device, the ink-consumption amount information is updated by subtracting the ink-consumption amount information upon detection of replacement of an ink supply unit from current ink-consumption amount information. Accordingly, the amount of ink consumed during a period from the point where the user replaced the ink supply unit to the point where the ink-consumption amount information has been actually updated is considered, and consequently the ink-consumption amount information can be accurately updated.

Further, as the user inputs an optimum value as an ink amount of a newly-set ink supply unit in accordance with the message as shown in FIG. 5, even if the ink amount is different from an presumed ink amount upon replacement of an ink supply unit, optimum residual ink-amount management can be performed without using an incorrect residual ink amount.

<Second Embodiment (FIGS. 8–11)>

Next, another printing operation by using the inkjet printing apparatus and the printhead described with reference to FIGS. 1 to 3 will be described.

FIG. 8 is an example of the ink-supply unit replacement check message according to this embodiment.

If the printing apparatus determines that there is a possibility that the user has replaced an ink supply unit and notifies the host device of the possibility, the host device displays the ink-supply unit replacement check message as shown in FIG. 8 in response to the notification.

When the message is displayed, the user selects the replaced ink supply unit and inputs it.

That is, if the color ink supply unit has been replaced, the user selects "color ink supply unit", while if the black ink supply unit has been replaced, the user selects "black ink supply unit". If the color ink supply unit and the black ink supply unit have been replaced, the user selects "color ink supply unit" and "black ink supply unit". If none of the ink supply units has been replaced, the user selects "not replaced". When the selection has been made, the user selects "OK" and terminates the confirmation of the replacement of ink supply unit.

Figure 9:
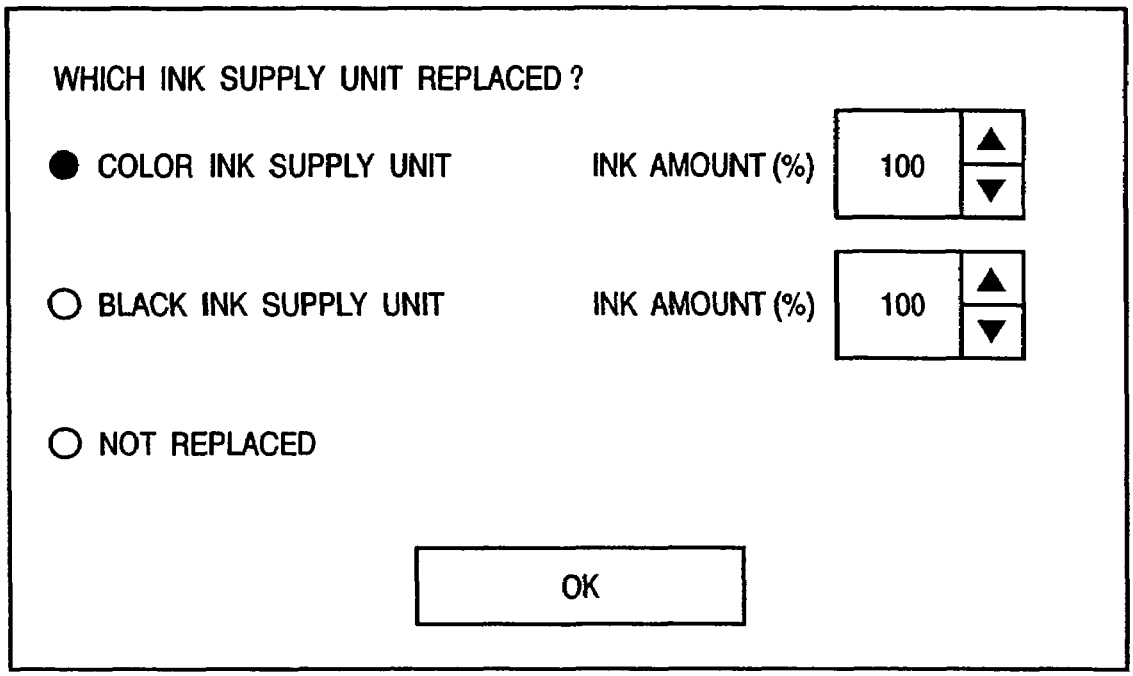

FIG. 9 is another example of the ink-supply unit replacement check message according to the present embodiment.

This message is also displayed for a similar reason to that described in FIG. 8. Accordingly, when the message is displayed, the user can notify the host device 1101 of the replacement of ink supply unit by using a man-machine interface.

In accordance with the displayed message, the user inputs the following designation regarding the replaced ink supply unit.

The user selects the replaced ink supply unit.

That is, if the color ink supply unit has been replaced, the user selects "color ink supply unit", while if the black ink supply unit has been replaced, the user selects "black ink supply unit". If the color ink supply unit and the black ink supply unit have been replaced, the user selects "color ink supply unit" and "black ink supply unit". If none of the ink supply units has been replaced, the user selects "not replaced".

Further, in a case where the message in FIG. 9 is displayed, the ink amount of the replaced ink supply unit can be inputted. If the ink supply unit has been replaced with a brandnew ink supply unit, the user inputs "100%" (default). If the ink supply unit has been replaced with a partially-used ink supply unit, the user inputs an arbitrary value from 1 to 99%.

When the selection and input have been completed, the user selects "OK" and terminates the confirmation of the replacement of an ink supply unit.

Next, the operations of the printing apparatus and the host device in the case where the message as shown in FIG. 8 or FIG. 9 is displayed will be described.

Figure 10A:
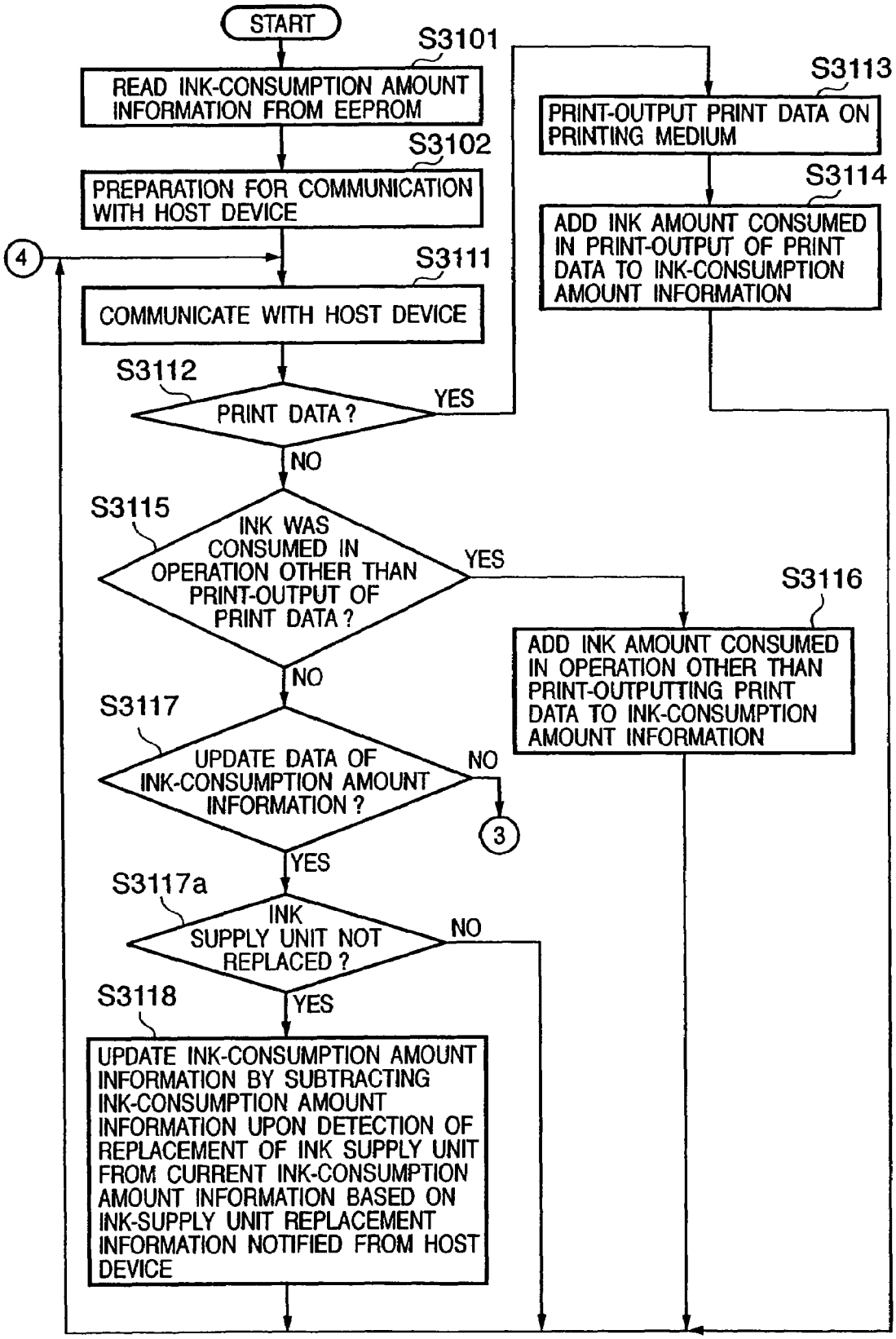
FIGS. 10A and 10B are flowcharts showing the operation of the printing apparatus according to the second embodiment of the present invention.
Figure 10B:
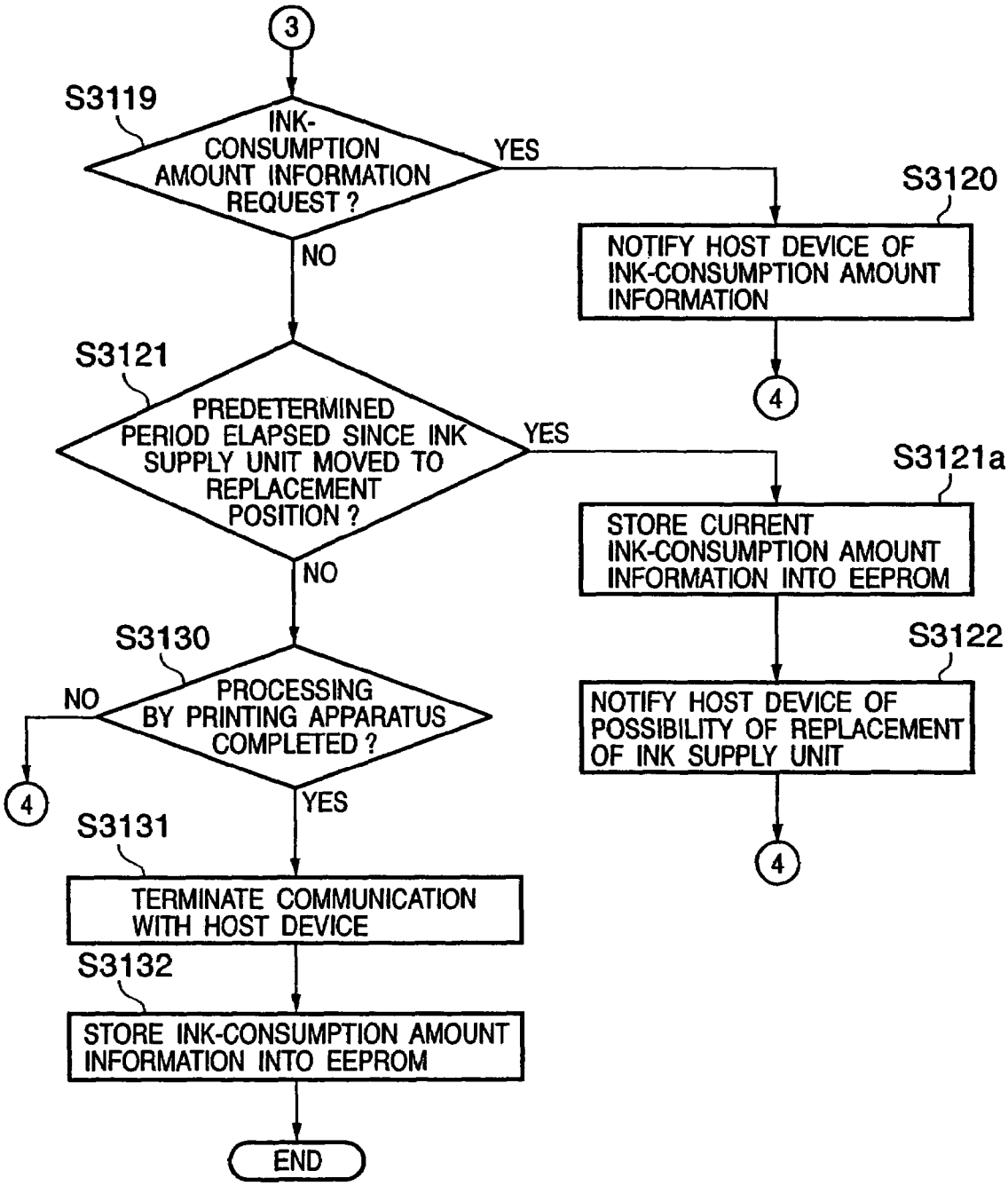

FIGS. 10A and 10B are flowcharts showing the operation of the printing apparatus according to a second embodiment of the present invention. Note that in FIGS. 10A and 10B, process steps corresponding to those described in the above embodiment have the same step reference numerals and explanations thereof will not be repeated. Here only process steps characteristic of this embodiment will be described.

In the processing according to the second embodiment, step S3117*a* is added to the processing C according to the first embodiment described with reference to FIGS. 6A and 6B.

By the above-described steps S3101 and S3102, steps S3111 to S3116 and step S3117, and especially, if it is determined at step S3117 that the received data is update data of the ink-consumption amount information, the process proceeds to step S3117*a*, at which it is determined whether or not the content of the update data of the ink-consumption amount information indicates that no ink supply unit has been replaced. If it is determined that the content of the data indicates that no ink supply unit has not been replaced, the process returns to step S3111 without updating the ink-consumption amount information.

On the other hand, if it is determined that the content of the data indicates that an ink supply unit has been replaced, the process proceeds to step S3118.

The processing thereafter is as described above.

Next, the processing on the host device side will be described.

FIG. 11 is a flowchart showing the operation of the host device according to the second embodiment of the present invention. Note that in FIGS. 11, process steps corresponding to those described in the above embodiment have the same step reference numerals and explanations thereof will not be repeated. Here only process steps characteristic of this embodiment will be described.

By the above-described steps S3201 and steps S3211 to S3216, and especially, if it is determined at step S3216 that the content of the communication with the printing apparatus is notification of possibility of replacement of ink supply unit from the printing apparatus, the process proceeds to step S3218*a*, at which the ink-supply unit replacement check message capable of confirming that no ink supply unit has been replaced, as shown in FIG. 8 or 9, is displayed.

Thereafter, the process waits for the user's response. At step S3219*a*, the user makes a response in accordance with the displayed ink-supply unit replacement check message as shown in FIG. 8 or 9. If the user confirms that no ink supply unit has been replaced, the user selects "not replaced" in the selection designation screen as shown in FIG. 8 or 9. Further, at step S3220*a*, the ink-consumption amount information is generated based on the content of the user's response, and the ink-consumption amount information of the replaced ink supply unit is notified to the printing apparatus. For example, if the response is made to the message as shown in FIG. 4, the ink-consumption amount information is 100% (or the predefined default value), while if the response is made to the message as shown in FIG. 5, the ink-consumption amount information is the value of a percentage (%) designated by the user. Further, if "not replaced" has been selected, the ink-consumption amount information is the information initially held in the printing apparatus. In this case, information indicating that data update has not been made may be notified. Thereafter, the process returns to step S3211.

The processing thereafter is as described above.

As described above, according to the present embodiment, in addition to the advantages obtained by the first embodiment, in a case where the user makes a response in accordance with the ink-supply unit replacement check message as shown in FIG. 8 or 9, the user can makes a response indicating that no ink supply unit has been replaced. Even if the user erroneously operates the printing apparatus, then the printing apparatus determines that there is a possibility that an if ink supply unit has been replaced because the predetermined period has elapsed since the ink supply unit moved to the replacement position but actually no ink supply unit has been replaced, proper processing can be performed.

<Third Embodiment (FIGS. 12A–12B)>

In this embodiment, another printing apparatus performed by using the inkjet printing apparatus and the printhead described with reference to FIGS. 1 to 3 will be described.

Note that the ink-supply unit replacement check message used in the present embodiment is the same as that described in FIGS. 4 and 5.

Figure 12A:
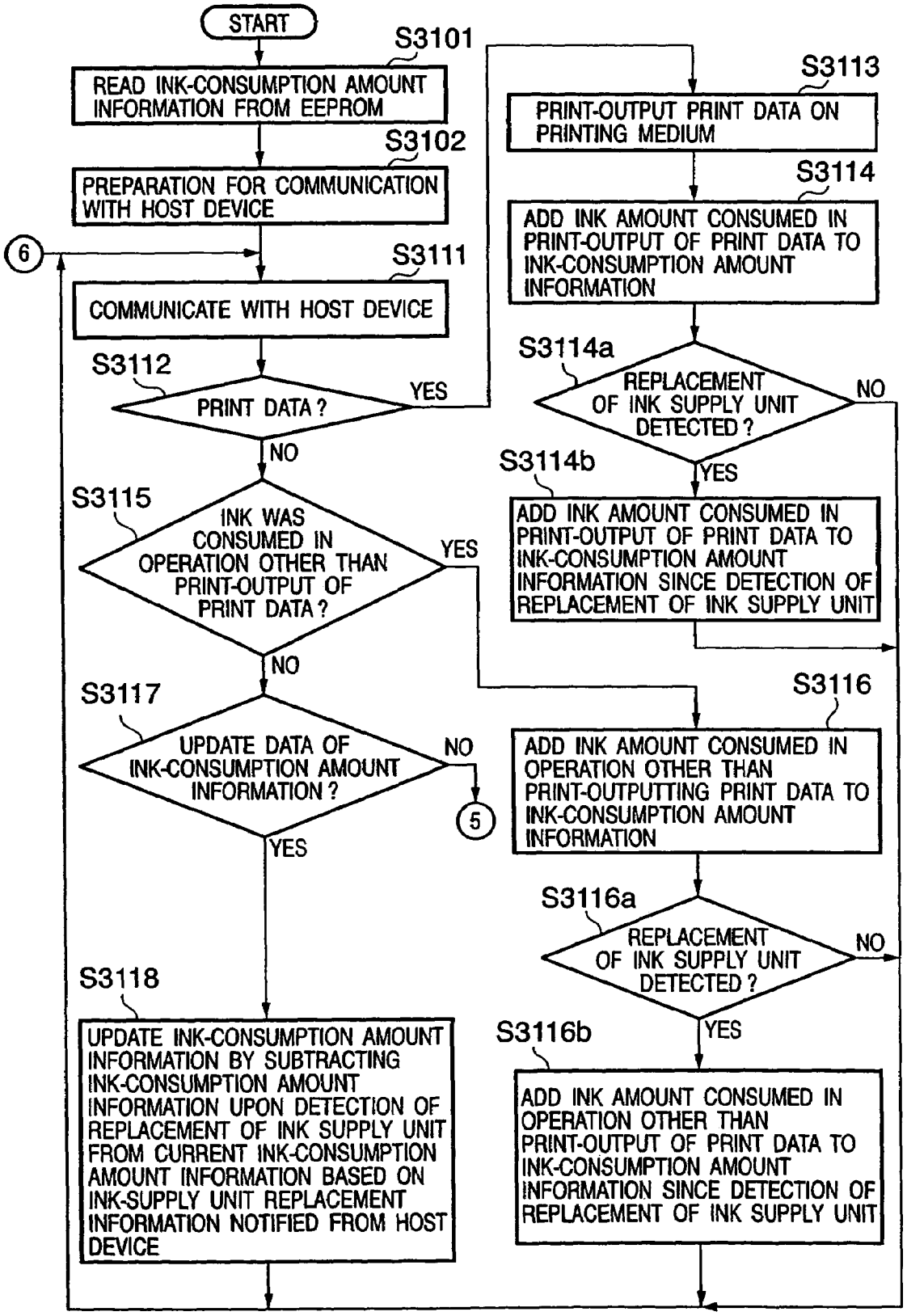
FIGS. 12A and 12B are flowcharts showing the operation of the printing apparatus according to a third embodiment of the present invention.
Figure 12B:
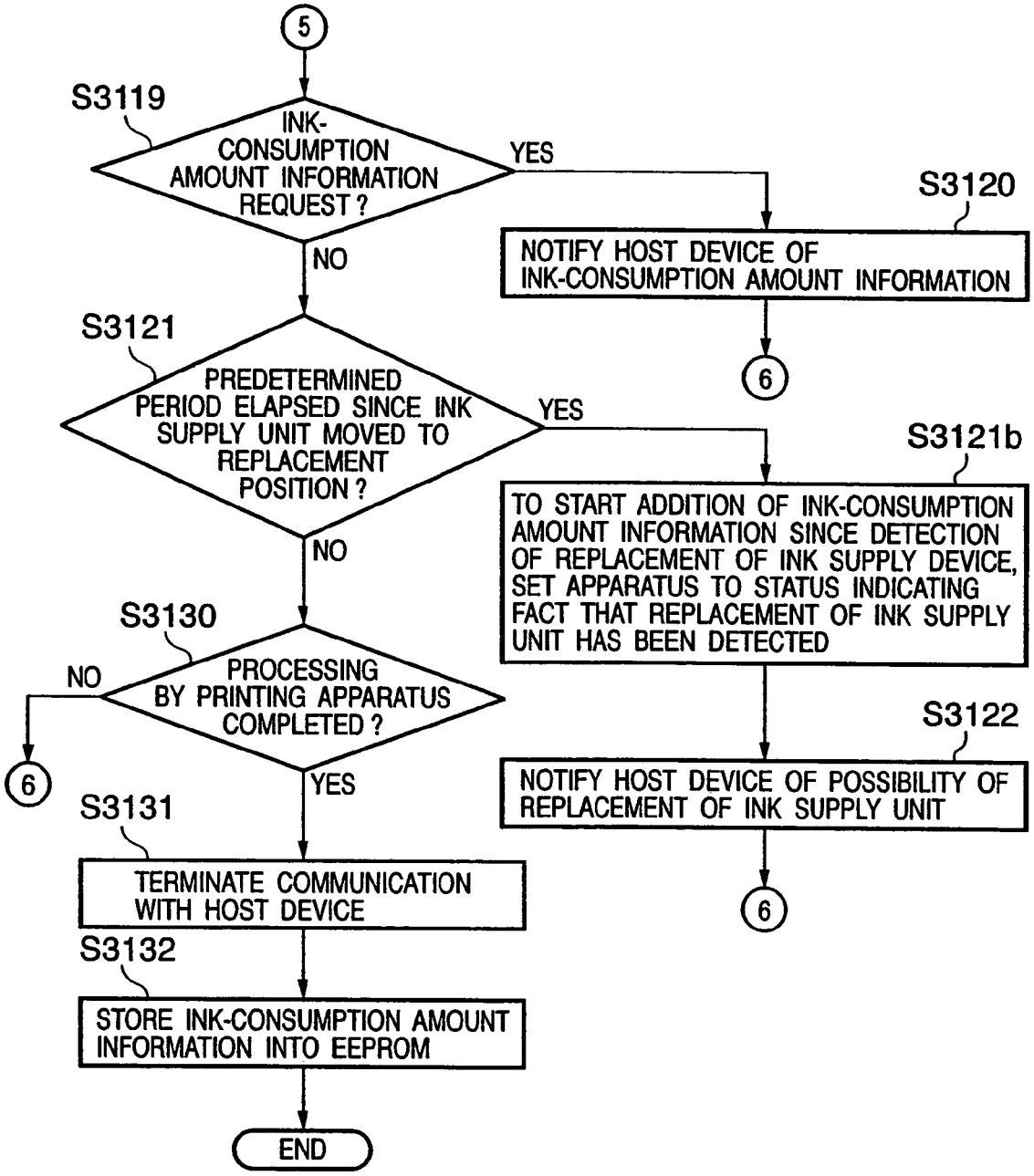

FIGS. 12A and 12B are flowcharts showing the operation of the printing apparatus according to a third embodiment of the present invention. Note that in FIGS. 12*a* and 12B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

After the above-described steps S3101 and S3102 and steps S3111 and S3114, further at step S3114*a*, it is determined whether or not replacement of an ink supply unit has been detected. If it is determined that the replacement of the ink supply unit has been detected (this is made by process at step S3121*b* to be described later), the process proceeds to step S3114*b*, at which the amount of ink consumed in print-output of print data is added to the ink-consumption amount information since the detection of the replacement of the ink supply unit. Thereafter, the process returns to step S3111. On the other hand, if it is determined that replacement of an ink supply unit has not been detected, the process returns to step S3111.

Further, after steps S3115 and S3116, further at step S3116*a*, it is determined whether or not replacement of an ink supply unit has been detected. If it is determined that the replacement of the ink supply unit has been detected (this is made by process at step S3121*b* to be described later), the process proceeds to step S3116*b*, at which the amount of ink consumed in an operation other than print-Output of print data is added to the ink-consumption amount information since the detection of the replacement of the ink supply unit. Thereafter, the process returns to step S3111. On the other hand, if it is determined that replacement of an ink supply unit has not been detected, the process returns to step S3111.

Further, after steps S3117 to S3120, if it is determined at step S3121 that a predetermined period has elapsed since the ink supply unit moved to the replacement position, the process proceeds to step S3121*b*, at which to start addition of the ink-consumption amount information since the detection of the replacement of the ink supply unit, the apparatus is set to a status indicating the fact that replacement of an ink supply unit has been detected.

The processing thereafter is as described above.

As described above, according to the present embodiment, in addition to the advantages obtained by the first embodiment, the ink consumption amount is managed by using two kinds of information, i.e., the ink-consumption amount information updated at each ink consumption, and the ink-consumption amount updated since detection of replacement of an ink supply unit. Accordingly, the ink-consumption amount information can be accurately updated by using, e.g., the ink-consumption amount information since detection of replacement of an ink supply unit, considering the amount of ink consumed during the period from user's replacement of an ink supply unit to the actual update of ink-consumption amount information managed by the printing apparatus.

<Fourth Embodiment (FIGS. 13A–13B)>

Next, another printing operation performed by using the inkjet printing apparatus and the printhead described with reference to FIGS. 1 to 3 will be described.

Further, the ink-supply unit replacement check message used in this embodiment is the same as that described in FIGS. 4 and 5.

Figure 13A:
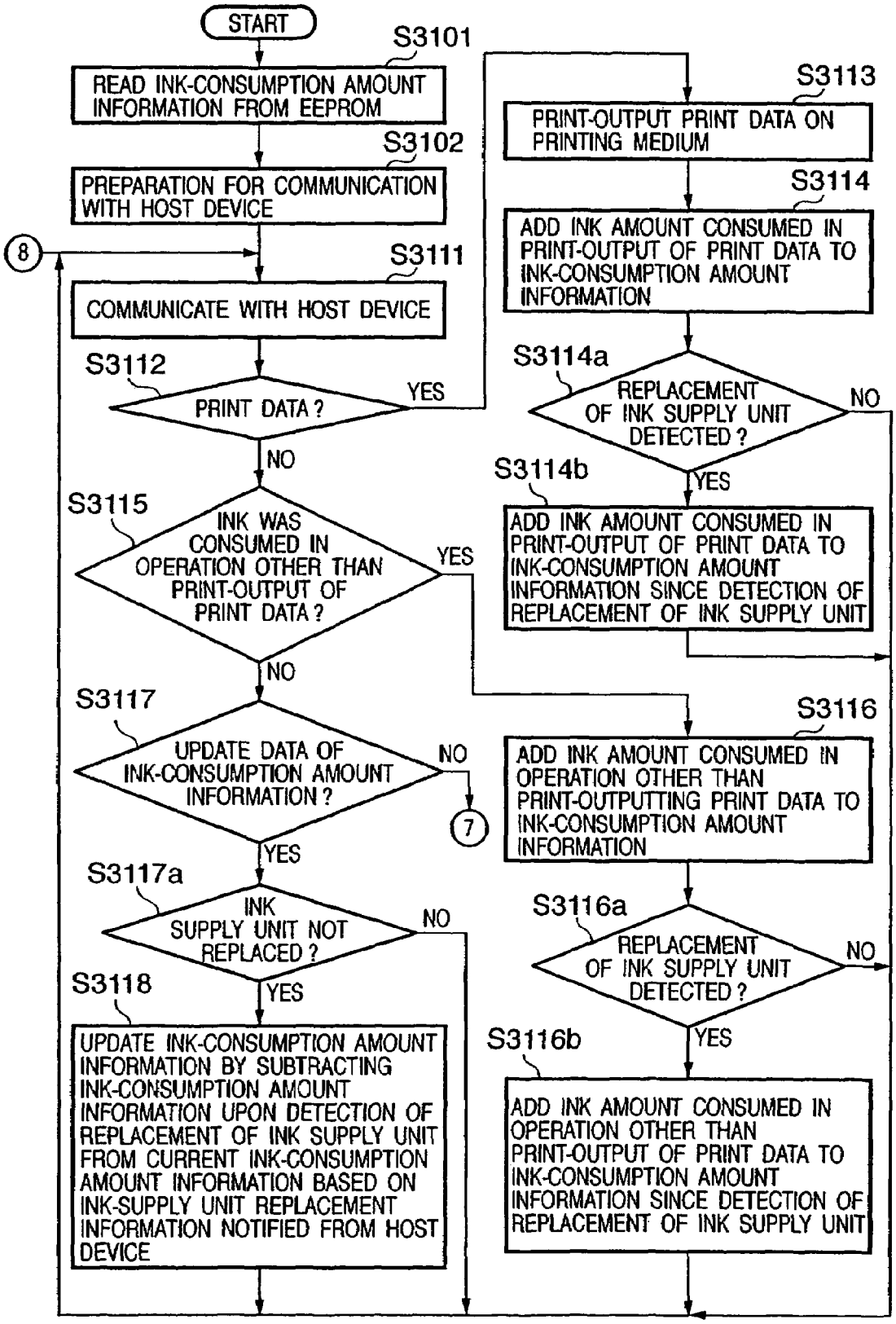
FIGS. 13A and 13B are flowcharts showing the operation of the printing apparatus according to a fourth embodiment of the present invention.
Figure 13B:
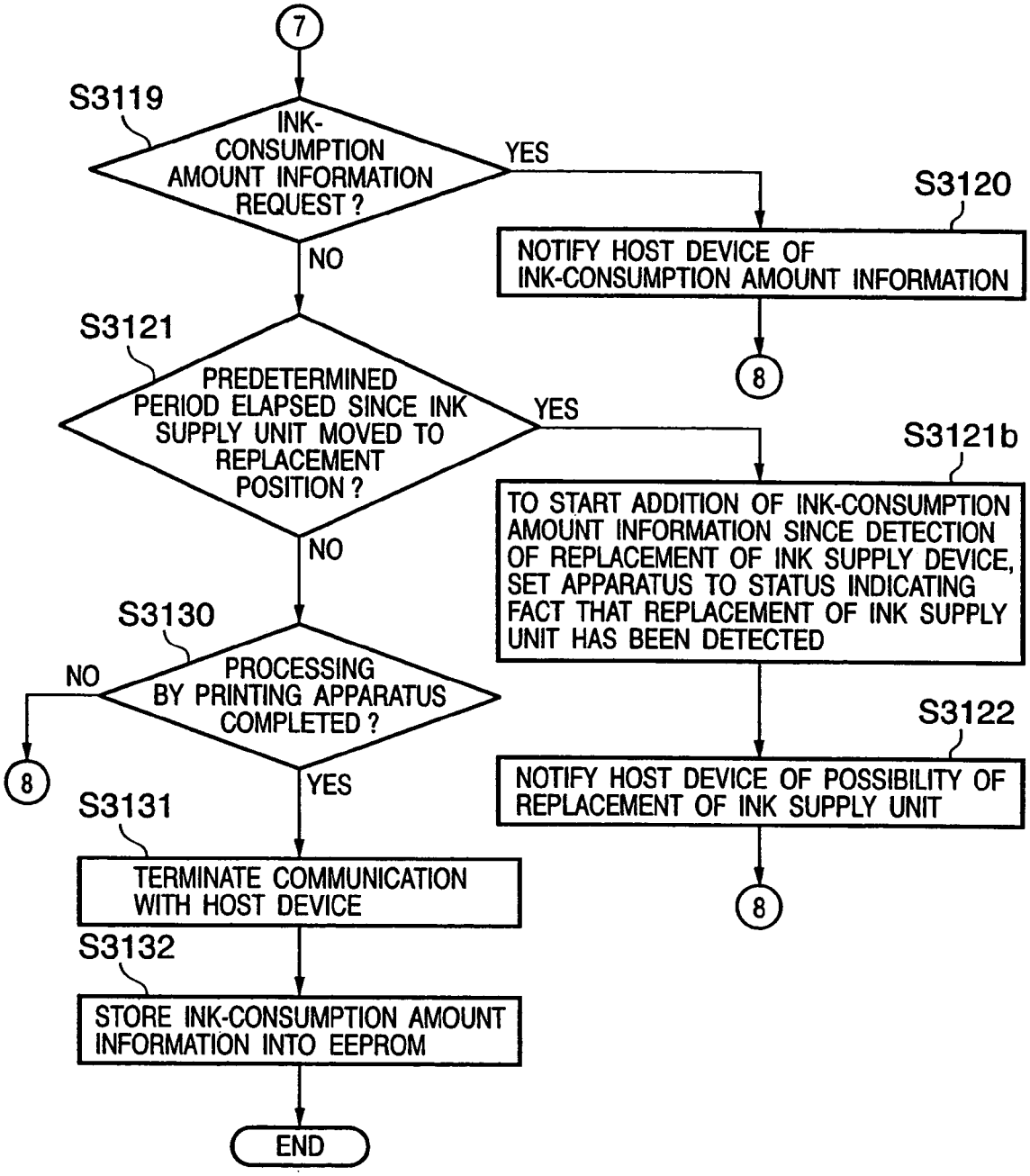

FIGS. 13A and 13B are flowcharts showing the operation of the printing apparatus according to a fourth embodiment of the present invention. Note that in FIGS. 13A and 13B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

In the processing according to the fourth embodiment, step S3117*a* is added to the processing according to the third embodiment described with reference to the flowcharts of FIGS. 12A and 12B.

By the above-described steps S3101 and S3102, steps S3111 to S3114, step S3114*a*, step S3114*b*, step S3115, step S3116, step S3116*a*, step S3116*b* and step S3117, and especially, if it is determined at step S3117 that the received data is update data of the ink-consumption amount information, the process proceeds to step S3117*a*, at which it is determined whether or not the content of the update data of the ink-consumption amount information indicates that no ink supply unit has been replaced. If it is determined that the content of the data indicates that no ink supply unit has been replaced, the process returns to step S3111 without updating the ink-consumption amount information.

On the other hand, if it is determined that the content of the data indicates that an ink supply unit has been replaced, the process proceeds to step S3118.

The processing thereafter is as described above.

As described above, according to the present embodiment, in addition to the advantages obtained by the second embodiment, in a case where the user makes a response in accordance with the ink-supply unit replacement check message as shown in FIG. 8 or 9, the user can make a response indicating that no ink supply unit has been replaced. Even if the user erroneously operates the printing apparatus, then the printing apparatus determines that there is a possibility that an ink supply unit has been replaced because the predetermined period has elapsed since the ink supply unit moved to the replacement position but actually no ink supply unit has been replaced, proper processing can be performed.

<Fifth Embodiment (FIGS. 14A–14B)>

Next, still another printing operation performed by using the inkjet printing apparatus and the printhead described with reference to FIGS. 1 to 3 will be described.

Further, the ink-supply unit replacement check message used in this embodiment is the same as that described in FIGS. 4 and 5.

Figure 14A:
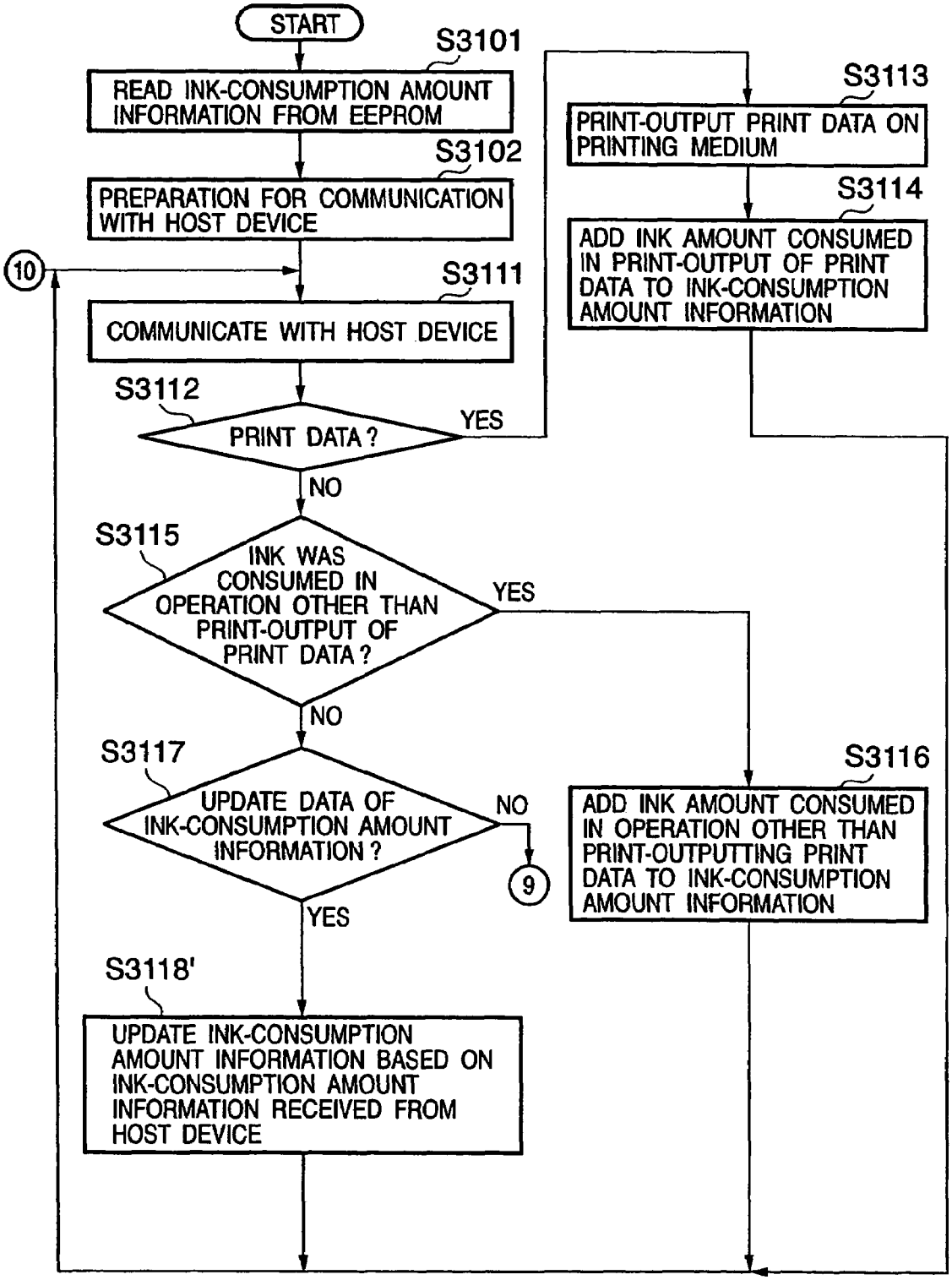
FIGS. 14A and 14B are flowcharts showing the operation of the printing apparatus according to a fifth embodiment of the present invention.
Figure 14B:
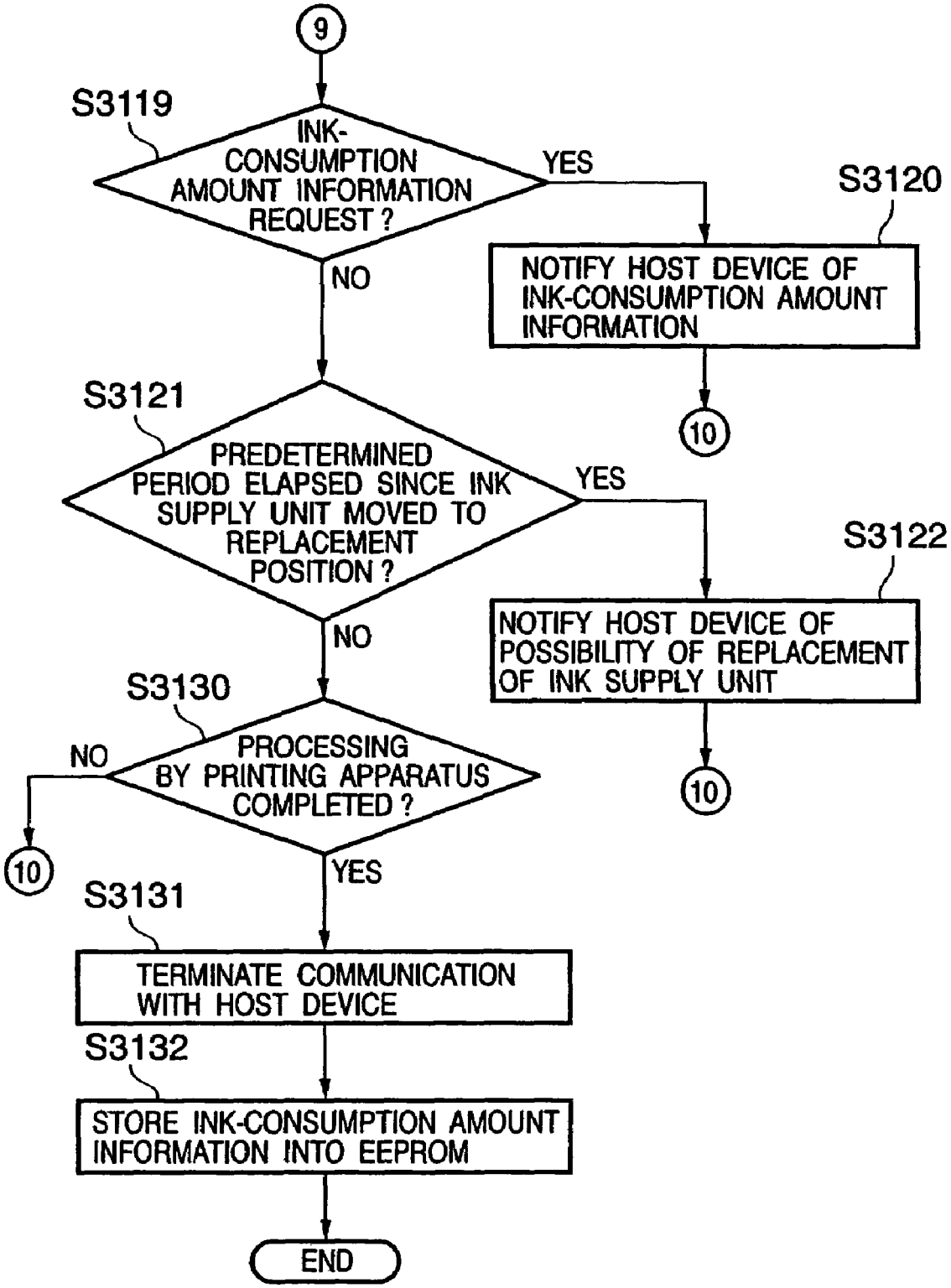

FIGS. 14A and 14B are flowcharts showing the operation of the printing apparatus according to a fifth embodiment of the present invention. Note that in FIGS. 14A and 14B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

In the processing according to the fifth embodiment, step S3118 of the processing according to the first embodiment described with reference to the flowcharts of FIGS. 6A and 6B is replaced with step S3118'.

At step S3118', the ink-consumption amount information stored in the EEPROM 1106 is updated based on the ink-consumption amount information received from the host device.

The processing thereafter is as described above.

As described above, according to the present embodiment, the printing apparatus detects that the user has replaced an ink supply unit and notifies the host device of the replacement of the ink supply unit, while the host device displays the ink-supply unit replacement check message, thereby urges the user to input proper ink-supply unit replacement information. Consequently the printing apparatus obtains ink-supply unit replacement information inputted by the user from the host device, and the ink-consumption amount information can be updated to the latest information by the obtained data.

<Sixth Embodiment (FIGS. 15A–15B)>

Next, still another printing operation performed by using the inkjet printing apparatus and the printhead described with reference to FIGS. 1 to 3 will be described.

Further, the ink-supply unit replacement check message used in the present embodiment is the same as that described in FIGS. 4 and 5.

Figure 15A:
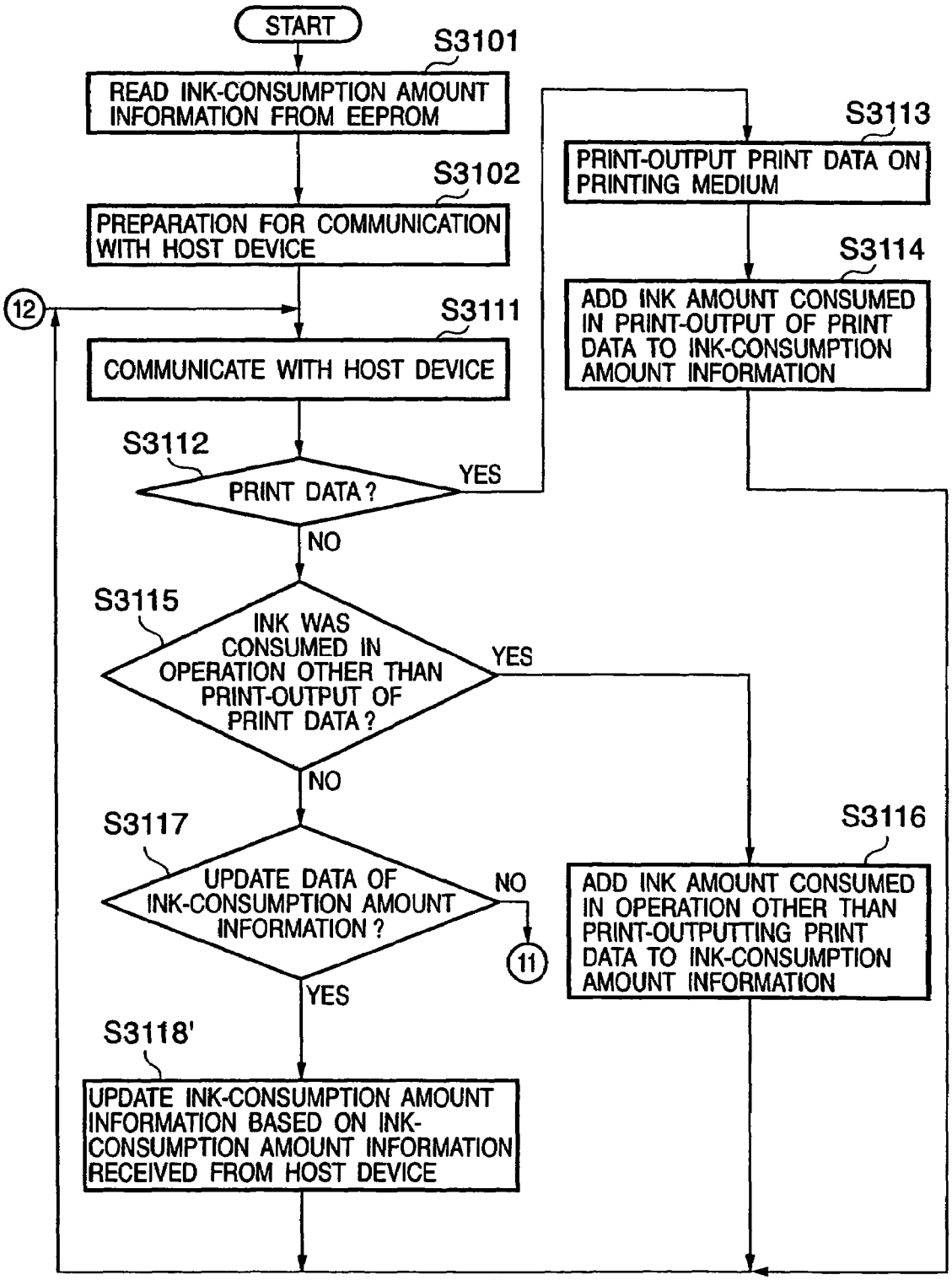
FIGS. 15A and 15B are flowcharts showing the operation of the printing apparatus according to a sixth embodiment of the present invention.
Figure 15B:
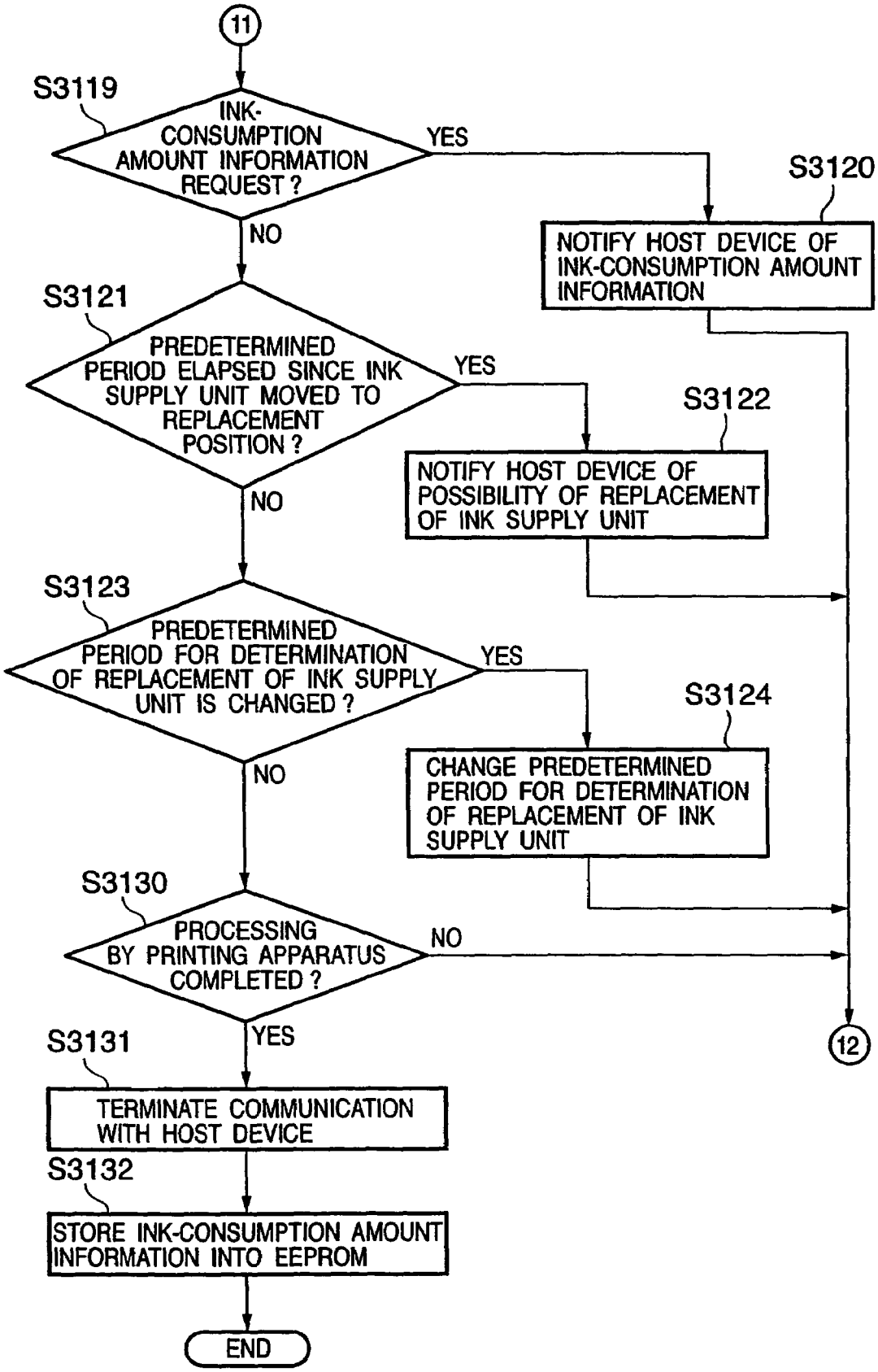

FIGS. 15A and 15B are flowcharts showing the operation of the printing apparatus according to a sixth embodiment of the present invention. Note that in FIGS. 15A and 15B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

In the processing according to the sixth embodiment, steps S3123 and S3124 are added to the processing according to the fifth embodiment described with reference to FIGS. 14A and 14B.

By the above-described steps S3101 and S102, steps S3111 to S3117, step S3118' and steps S3119 to S3121, and especially, if it is determined at step S3121 that a predetermined period has not elapsed since the ink supply unit moved to the replacement position, the process proceeds to step S3123, at which it is determined whether or not the received data is either an instruction to change the predetermined period used as a threshold value for determination of replacement of an ink supply unit or data to change the predetermined period. If it is determined that the received data is either an instruction to change the predetermined period used as a threshold value for determination of replacement of an ink supply unit or data to change the predetermined period, the process proceeds to step S3124, at which the threshold value is changed in accordance with the received data. Then, the process returns to step S3111.

On the other hand, if it is determined that the received data is neither an instruction to change the predetermined period used as a threshold value for determination of replacement of an ink supply unit nor data to change the predetermined period, the process returns to step S3111.

The processing thereafter is as described above.

Note that the predetermined period may be changed by incrementation or decrementation by a value set in the printing apparatus in accordance with an instruction from the host device, or may be changed by a change instruction and its associated data to change the period received from the host device.

As described above, according to the present embodiment, the threshold value for determination of replacement of an ink supply unit can be appropriately changed in accordance with an instruction from the host device.

<Seventh Embodiment (FIG. 16)>

Next, still another printing operation performed by using the inkjet printing apparatus and the printhead described with reference to FIGS. 1 to 3 will be described.

Note that the ink-supply unit replacement check message used in this embodiment is the same as that described in FIGS. 4 and 5.

FIG. 16 is flowchart showing the operation of the printing apparatus according to a seventh embodiment of the present invention. Note that in FIG. 16, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

In the processing according to the seventh embodiment, steps S3117 and S3118 are omitted from the processing according to the first embodiment described with reference to the flowcharts of FIGS. 6A and 6B, and step S3122 is replaced with step S3122*a*.

If it is determined at step S3121 that the predetermined period has elapsed since the ink supply unit moved to the replacement position, it is determined at step S3122*a* that the ink supply unit has been replaced, and the ink-consumption amount information is updated to a predetermined ink amount.

The other processing is the same as that shown in FIGS. 6A and 6B.

As described above, according to the present embodiment, if it is considered that there is no erroneous operation in replacement of an ink supply unit by a user, the residual-ink amount can be managed with simpler processing in comparison with the processing according to the first and fifth embodiments.

<Eighth Embodiment (FIGS. 17A–17B)>

Next, still another printing operation performed by using the inkjet printing apparatus and the printhead described with reference to FIGS. 1 to 3 will be described.

Further, note that the ink-supply unit replacement check message used in this embodiment is the same as that described in FIGS. 4 and 5.

Figure 17A:
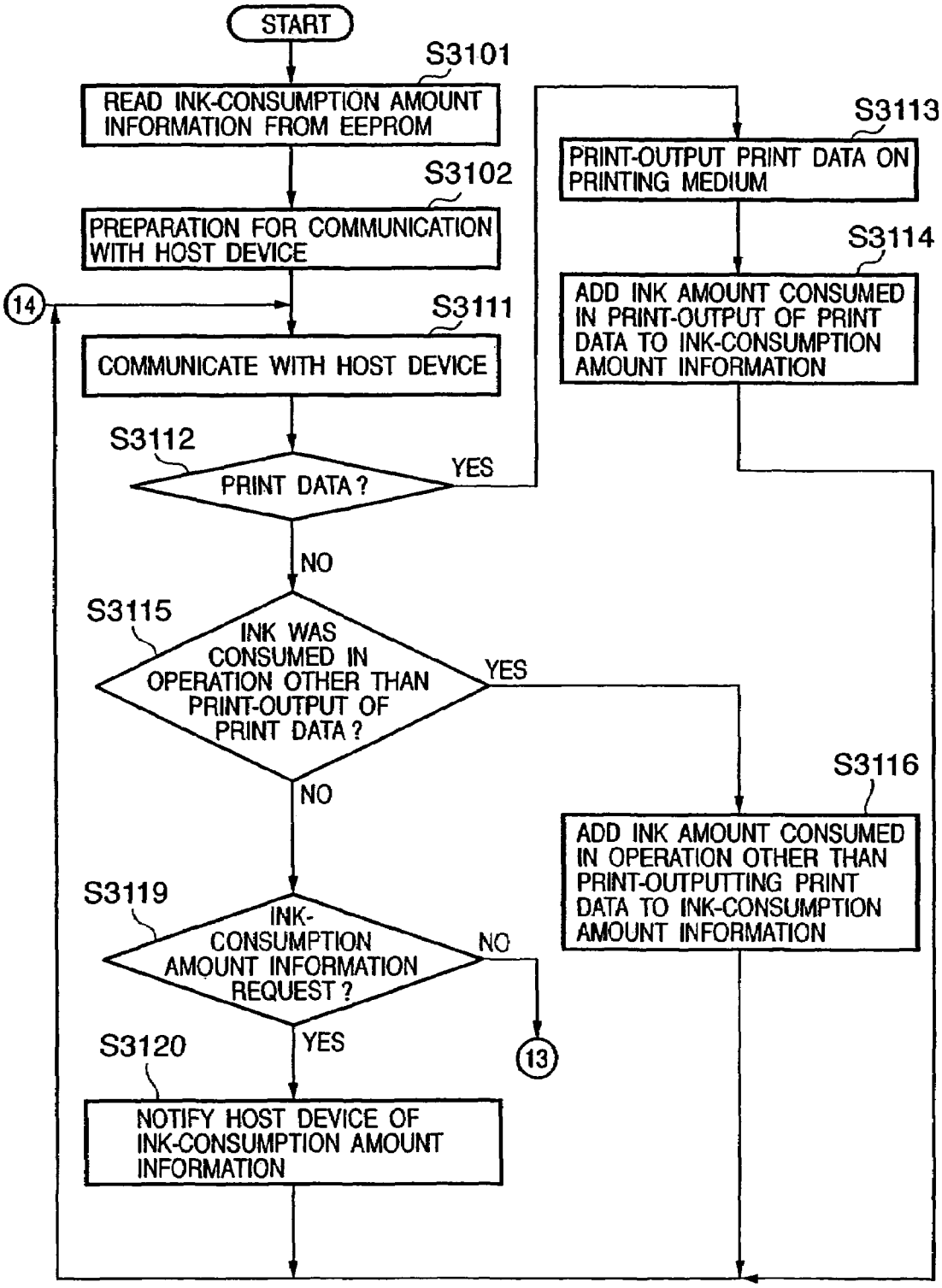
FIGS. 17A and 17B are flowcharts showing the operation of the printing apparatus according to an eighth embodiment of the present invention.
Figure 17B:
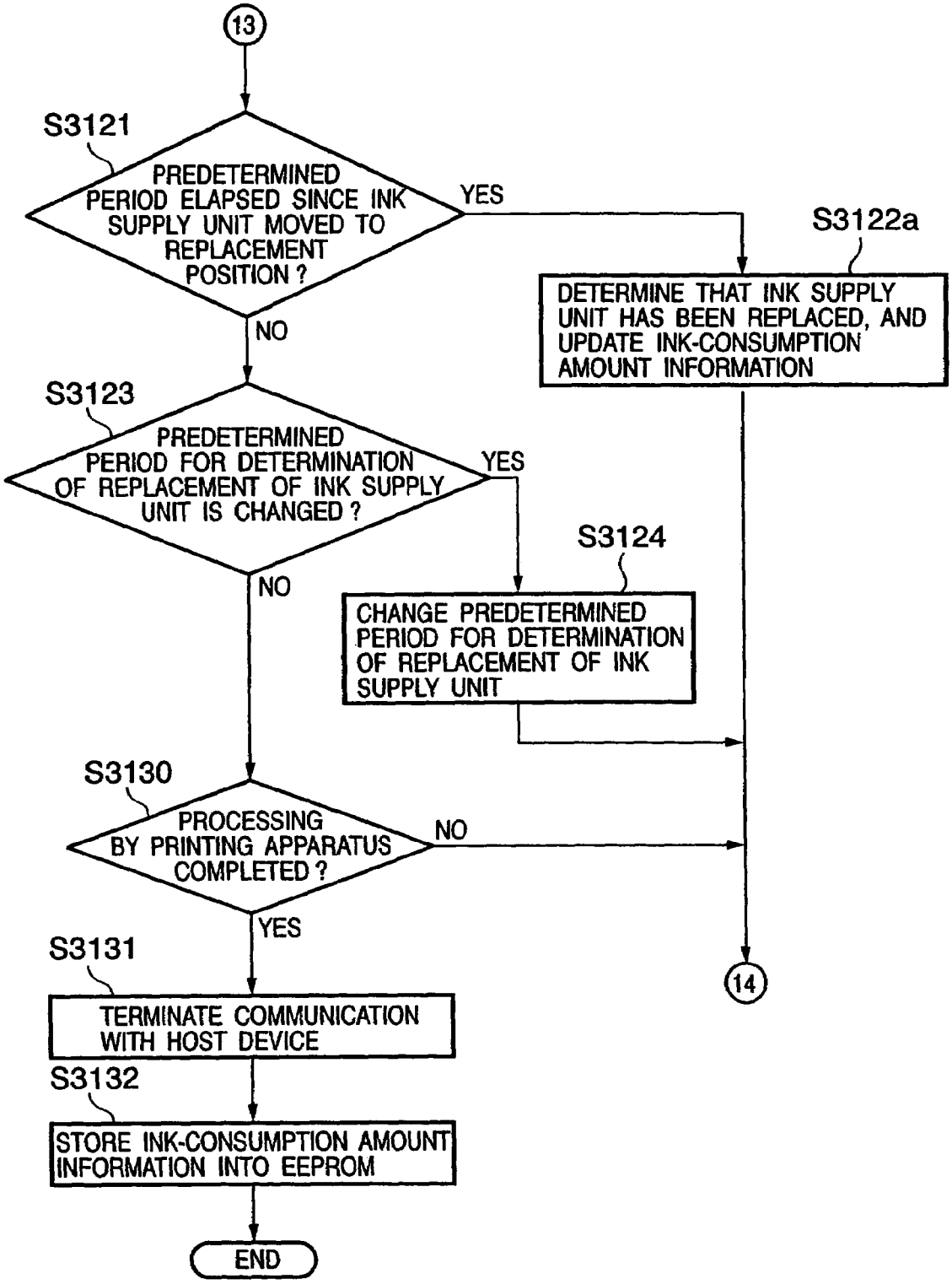

FIGS. 17A and 17B are flowcharts showing the operation of the printing apparatus according to an eighth embodiment of the present invention. Note that in FIGS. 17A and 17B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

In the processing according to the eighth embodiment, steps S3123 and S3124 described in the sixth embodiment are added to the processing according to the seventh embodiment described with reference to the flowchart of FIG. 16.

As steps S3123 and S3124 are as described above, explanations thereof will not be repeated.

The other processing is the same as that shown in FIG. 16.

As described above, according to the present embodiment, if it is considered that there is no erroneous operation in replacement of an ink supply unit by a user, the residual-ink amount can be managed with simpler processing in comparison with the processing according to the first and fifth embodiments. In addition, the threshold value for determination of replacement of an ink supply unit can be more appropriately set.

<Ninth Embodiment (FIGS. 18–20)>

Figure 18:
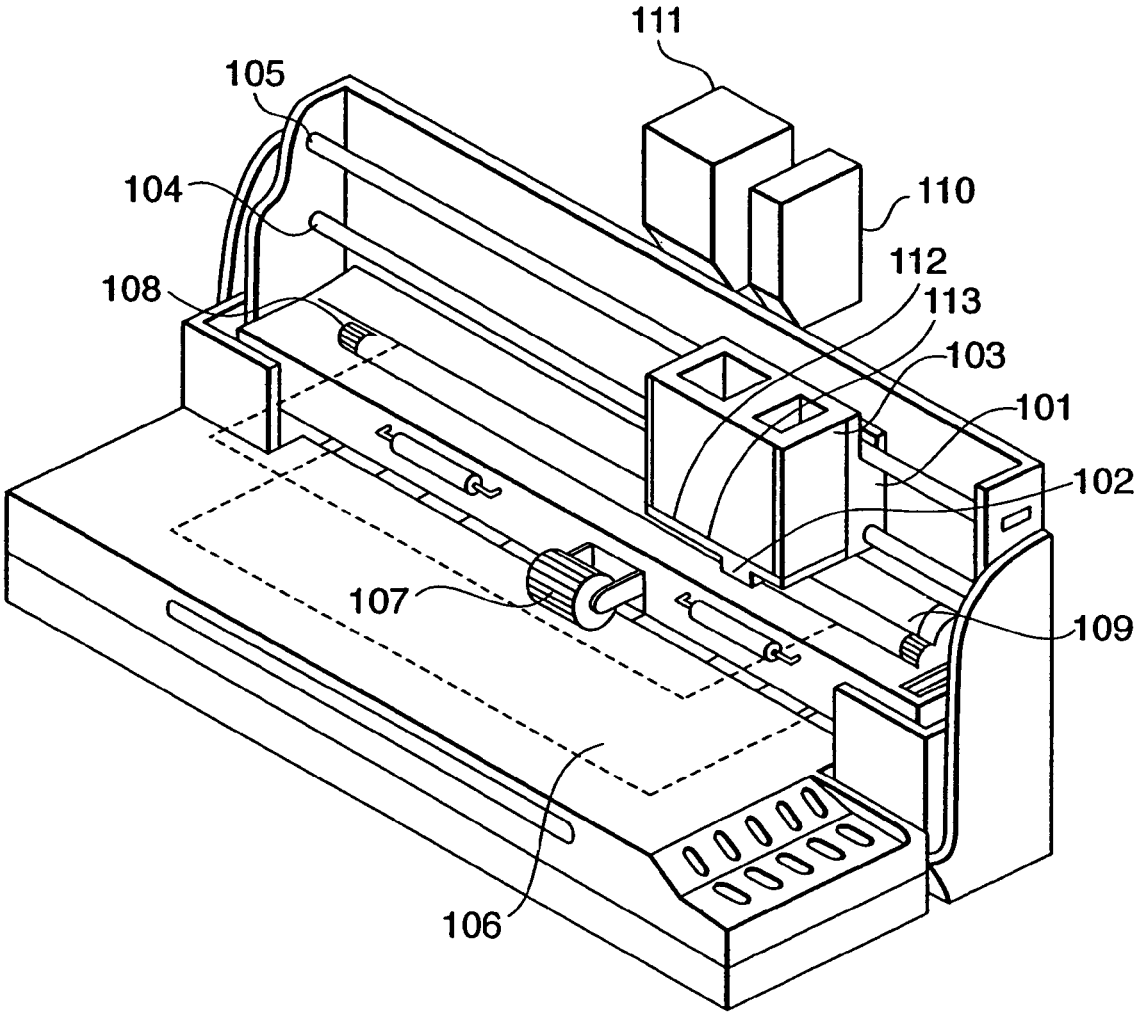
FIG. 18 is a perspective view showing the structure of the inkjet printing apparatus according to another embodiment of the present invention.

FIG. 18 is a perspective view showing the structure of the inkjet printing apparatus according to a ninth embodiment of the present invention.

In FIG. 18, constituent elements corresponding to those in FIG. 1 have the same reference numerals, and explanations thereof will not be repeated. Here only elements characteristic of this embodiment will be described.

As shown in FIG. 18, the printing apparatus has a color-ink supply unit sensor 312 which discriminates whether or not a color-ink supply unit 310 is attached and a black-ink supply unit sensor 313 which discriminates whether or not a black-ink supply unit 311 is attached.

Note that the printhead mounted on the printing apparatus is the same as that described in FIG. 2.

Figure 19:
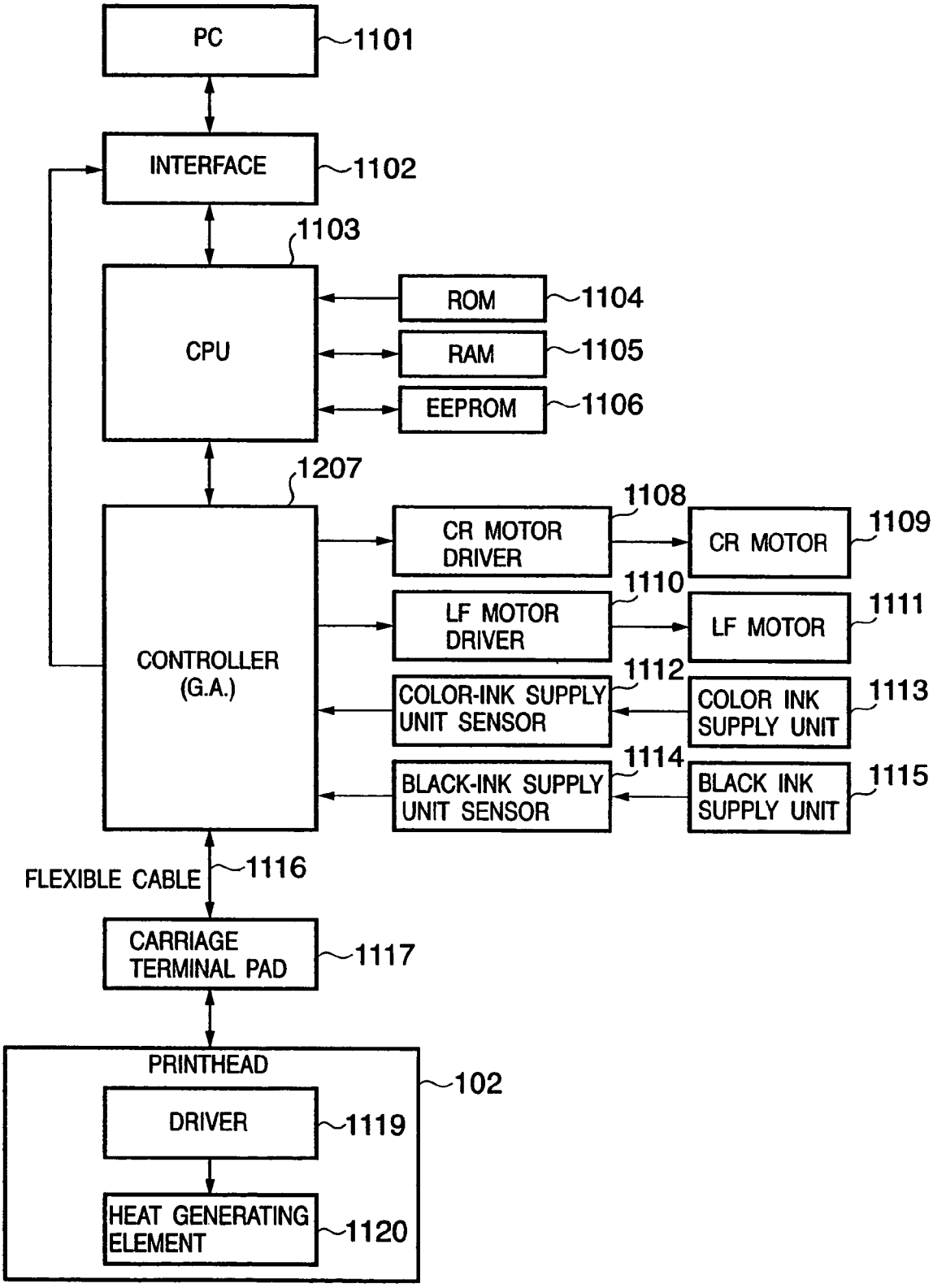
FIG. 19 is a block diagram showing the control construction of the printing apparatus in FIG. 18.

FIG. 19 is a block diagram showing the control construction of the printing apparatus in FIG. 18. Note that in FIG. 19, constituent elements corresponding to those in FIG. 1 have the same reference numerals, and explanations thereof will not be repeated.

In FIG. 19, numeral 1212 denotes a color-ink supply unit sensor which discriminates attachment/removal of a color-ink supply unit; 1213, the color-ink supply unit; 1214, a black-ink supply unit sensor which discriminates attachment/removal of a black-ink supply unit; 1215, the black-ink supply unit.

Further, the ink-supply unit replacement check message used in the present embodiment is the same as that described in FIGS. 4 and 5.

Figure 20A:
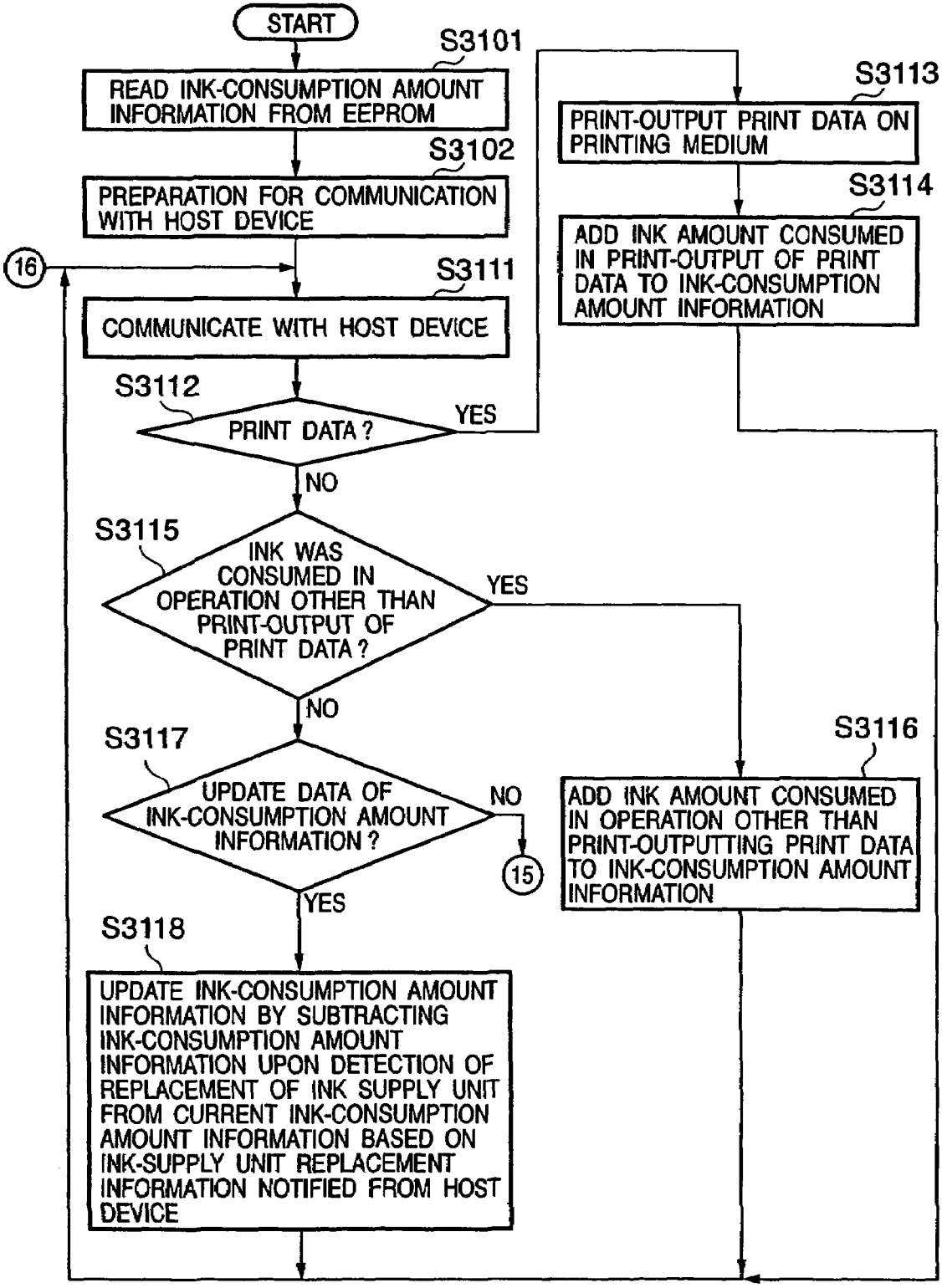
FIGS. 20A and 20B are flowcharts showing the operation of the printing apparatus according to a ninth embodiment of the present invention.
Figure 20B:
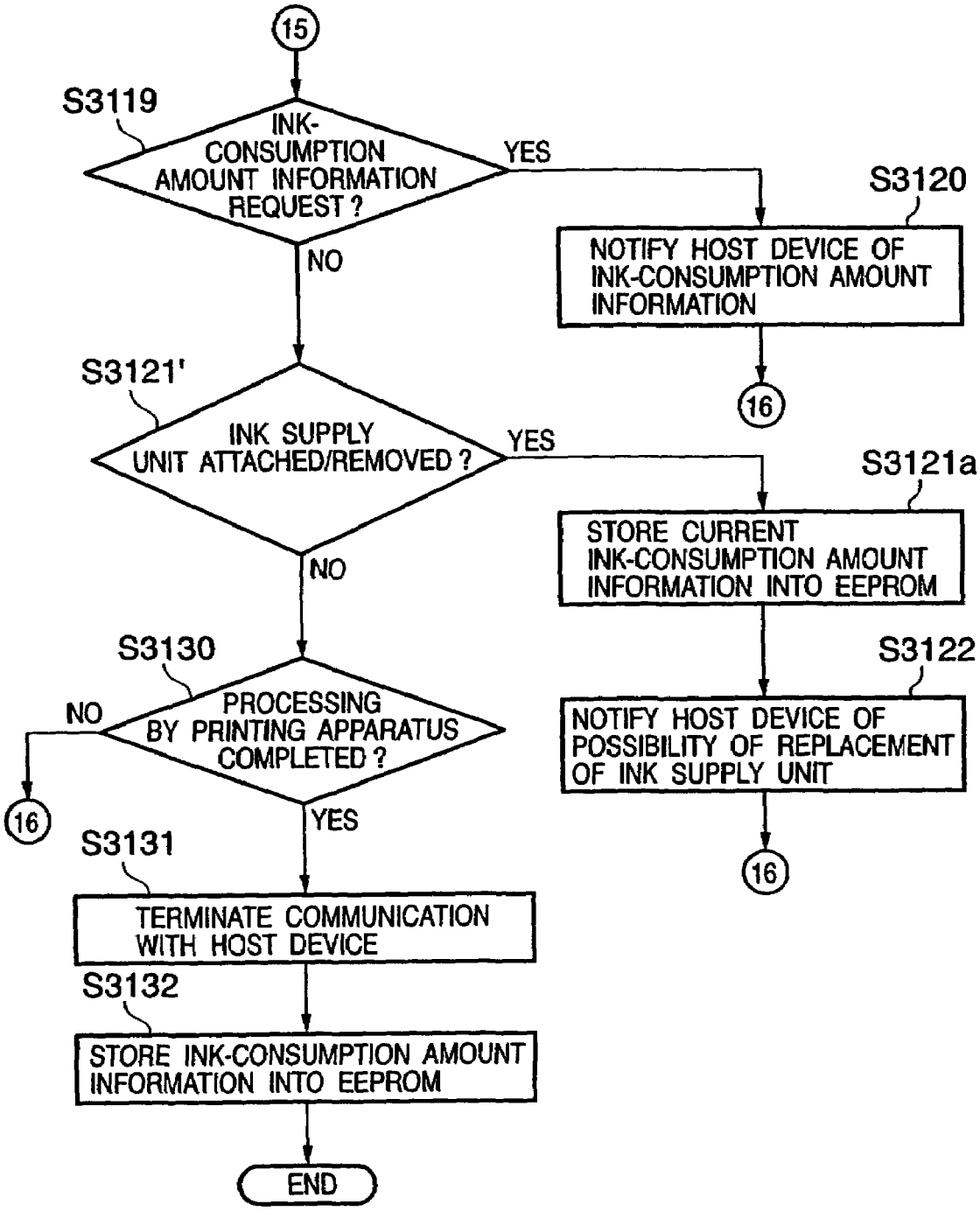

FIGS. 20A and 20B are flowcharts showing the operation of the printing apparatus according to the ninth embodiment of the present invention. Note that in FIGS. 20A and 20B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

By the above-described steps S3101 and S3102, steps S3111 to S3120, and especially, if it is determined at step S3119 that the received data is not an ink-consumption amount information request, the process proceeds to step S3121', at which it is determined whether or not the ink supply unit has been attached/removed.

If it is determined that the ink supply unit has been attached/removed, the process proceeds to the above-described step S3121*a*, while if it is determined that the ink supply unit has not been attached/removed, the process proceeds to step S3130.

The processing thereafter is as described above.

As described above, according to the present embodiment, removal/removal of an ink-supply unit is discriminated based on sensor outputs from the color-ink supply unit sensor and the black-ink supply unit sensor provided in the printing apparatus, and in accordance with the result of discrimination, the host device is notified of a possibility of replacement of an ink supply unit.

<Tenth Embodiment (FIGS. 21A–21B)>

Next, still another printing operation performed by using the inkjet printing apparatus described with reference to FIGS. 18 and 19 and the printhead described with reference to FIG. 2 will be described.

Further note that the ink-supply unit replacement check message used in this embodiment is the same as that described in FIGS. 8 and 9.

Figure 21A:
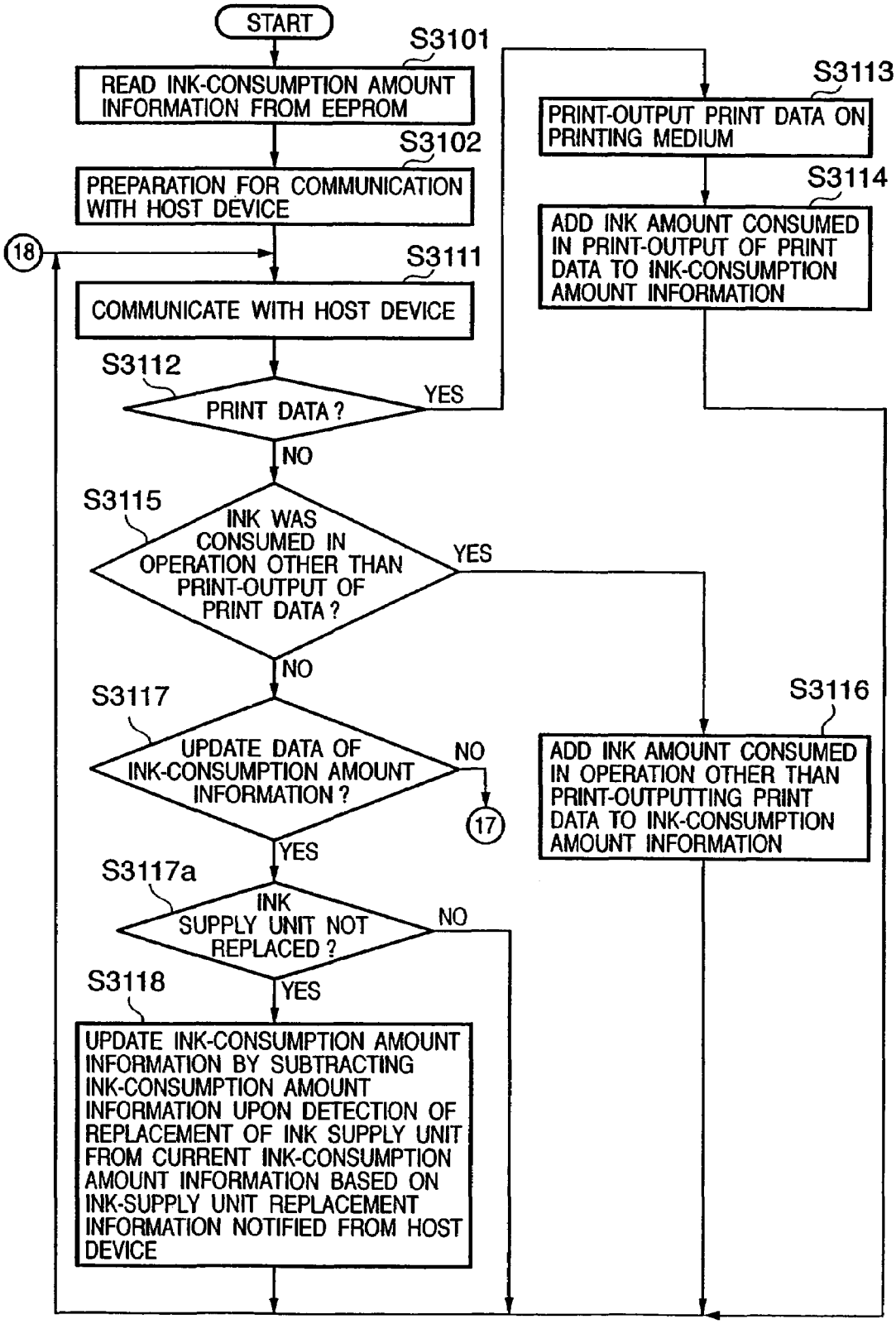
FIGS. 21A and 21B are flowcharts showing the operation of the printing apparatus according to a tenth embodiment of the present invention.
Figure 21B:
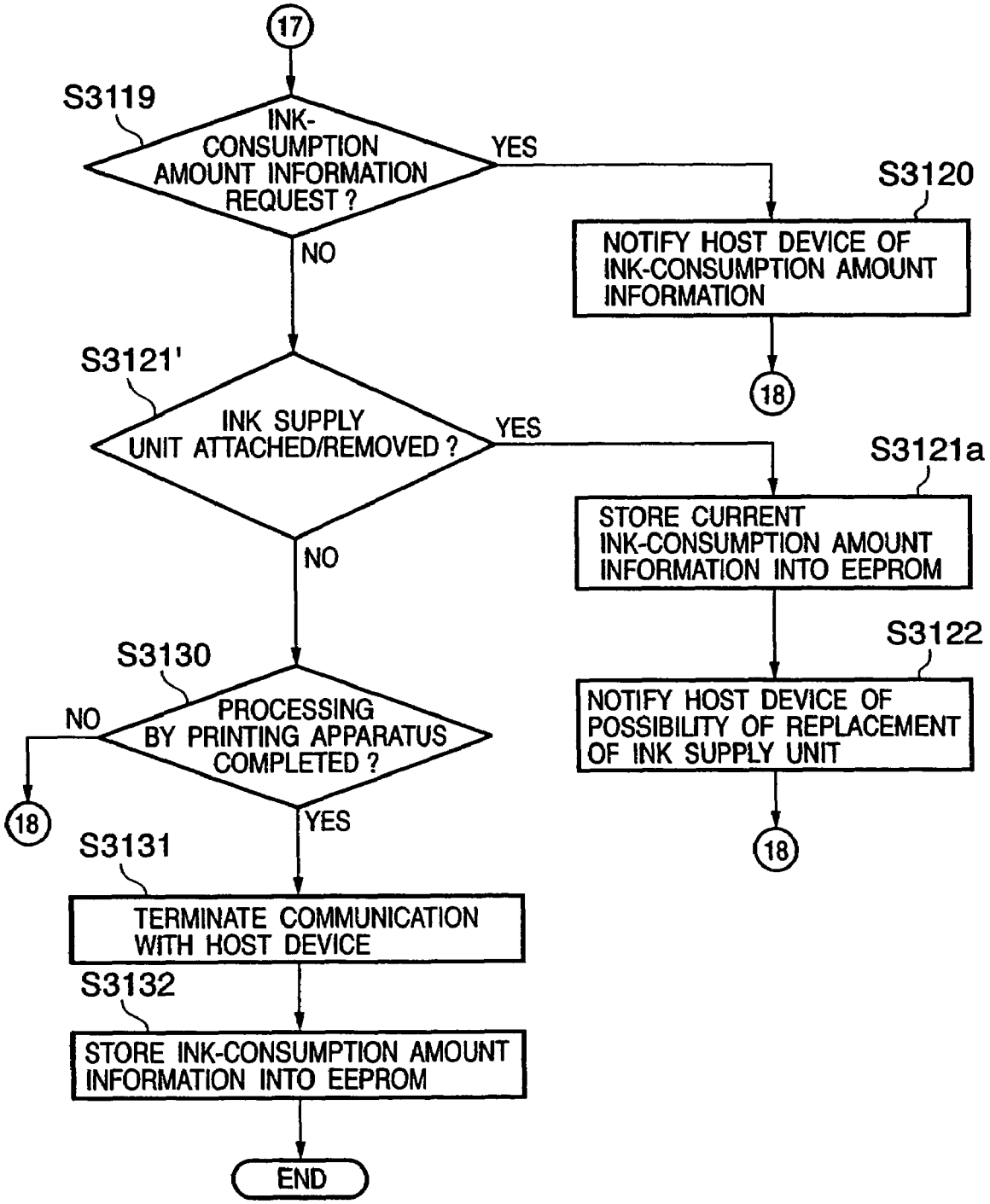

FIGS. 21A and 21B are flowcharts showing the operation of the printing apparatus according to a tenth embodiment of the present invention. Note that in FIGS. 21A and 21B, process steps corresponding to those described in the above embodiment have the same step reference numerals and explanations thereof will not be repeated. Here only process steps characteristic of this embodiment will be described. Further, as the operation on the host device side is the same as that described in the second embodiment with reference to FIG. 11, an explanation thereof will be omitted.

By the above-described steps S3101 and S3102, steps S3111 to S3117, and especially, if it is determined at step S3117 that the received data is update data of the ink-consumption amount information, the process proceeds to step S3117*a*, at which it is determined whether or not the content of the update data of the ink-consumption amount information indicates replacement of an ink supply unit. If it is determined that the content of the data does not indicate replacement of an ink supply unit, the process returns to step S3111 without updating the ink-consumption amount information.

On the other hand, if it is determined that the content of the data indicates the replacement of an ink supply unit, the process proceeds to step S3118.

The processing thereafter is as described above.

As described above, according to the present embodiment, in addition to the advantages obtained by the ninth embodiment, as the user can make a response indicating that no ink supply unit has been replaced according to the ink supply unit replacement checking message shown in FIG. 8 or FIG. 9, it can be determined in accordance with the response whether or not the replacement of ink supply unit has occurred. By this arrangement, proper processing can be performed upon the user's erroneous operation of the printing apparatus, e.g., removing the ink supply device and attaching it again.

<Eleventh Embodiment (FIGS. 22A–22B)>

Next, still another printing operation performed by using the inkjet printing apparatus described with reference to FIGS. 18 and 19 and the printhead described with reference to FIG. 2 will be described.

Further, the ink-supply unit replacement check message used in this embodiment is the same as that described in FIGS. 4 and 5.

Figure 22A:
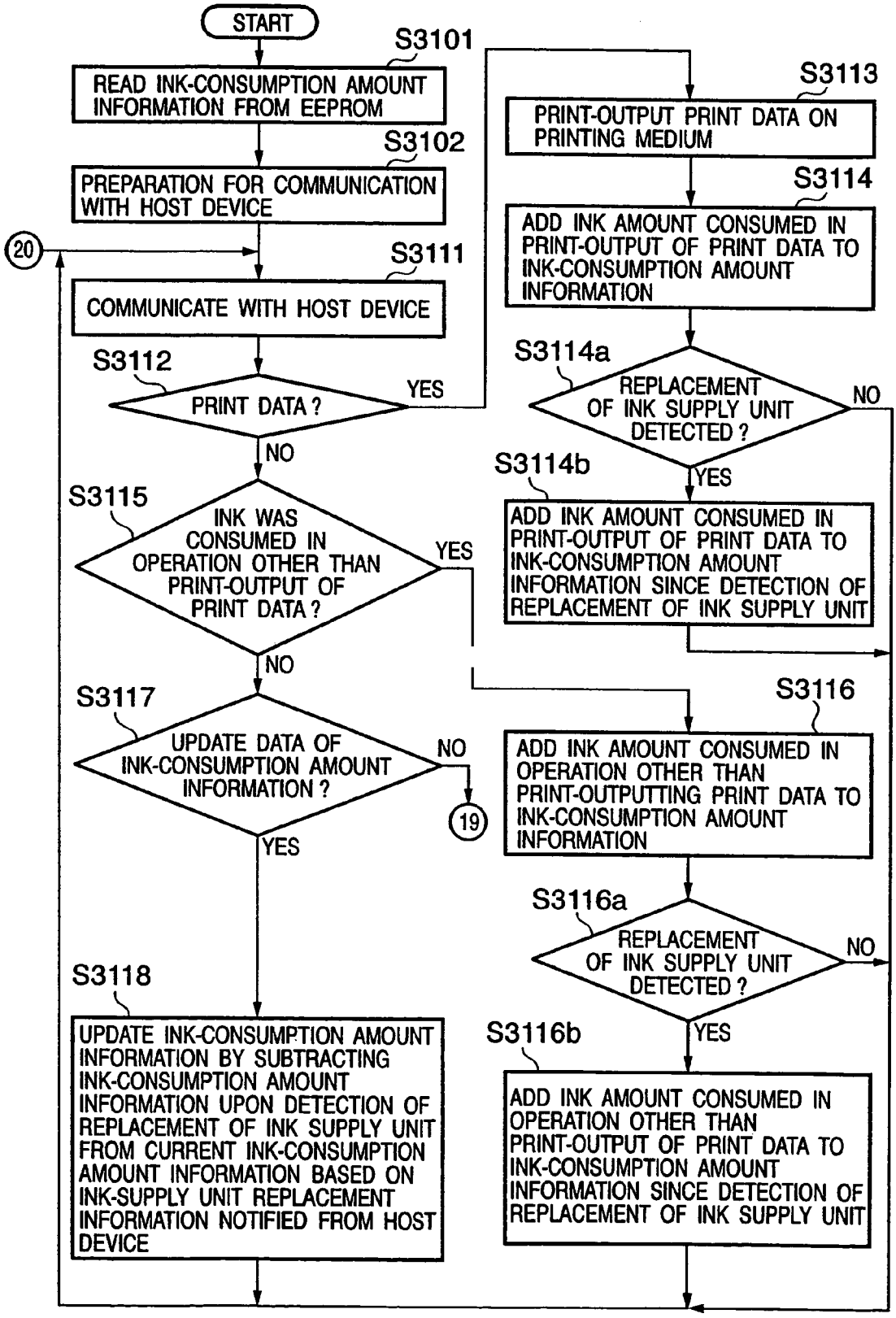
FIGS. 22A and 22B are flowcharts showing the operation of the printing apparatus according to an eleventh embodiment of the present invention.
Figure 22B:
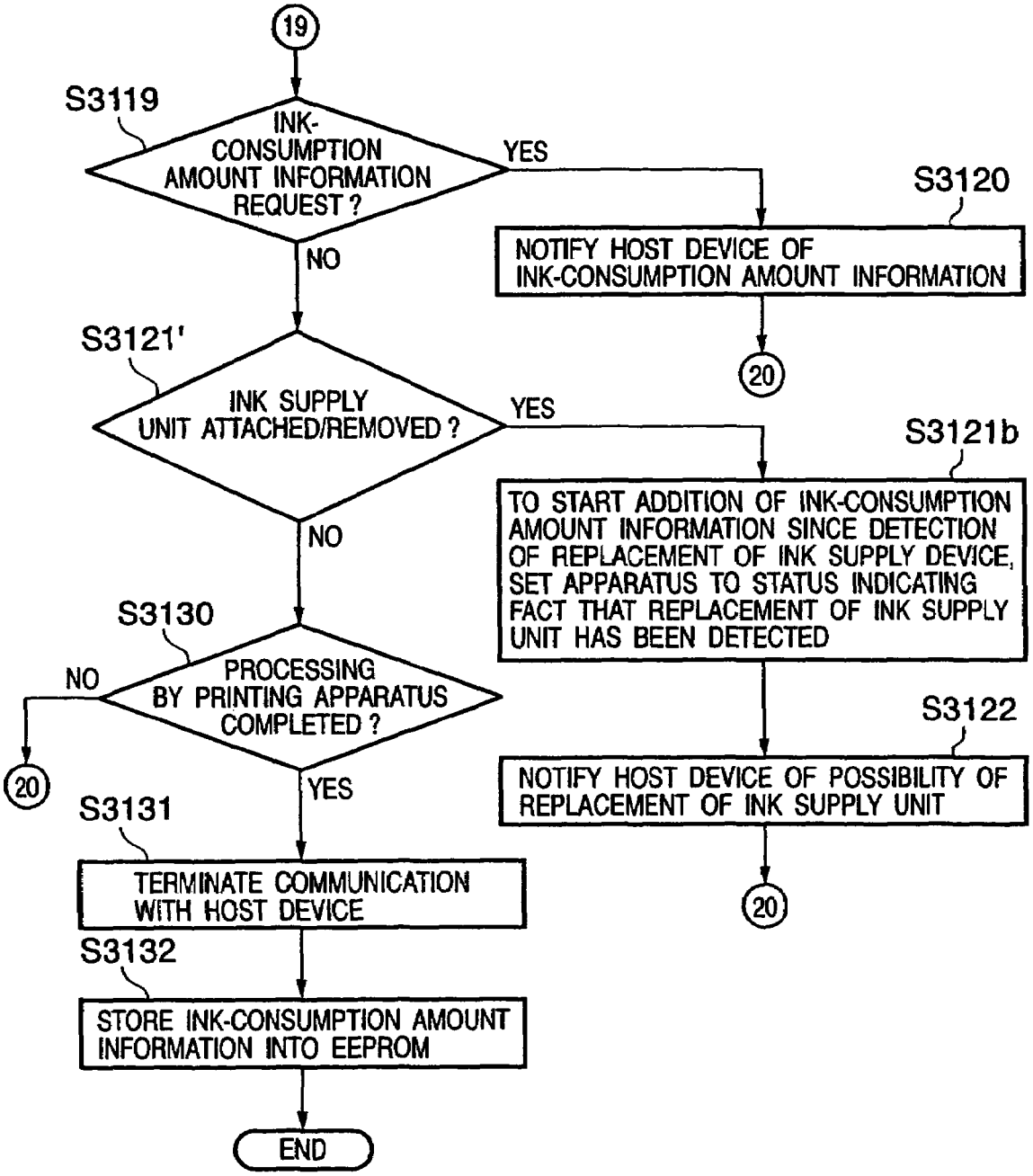

FIGS. 22A and 22B are flowcharts showing the operation of the printing apparatus according to an eleventh embodiment of the present invention. Note that in FIGS. 22A and 22B, process steps corresponding to those described in the above embodiment have the same step reference numerals and explanations thereof will not be repeated. Here only process steps characteristic of this embodiment will be described. Further, as the operation on the host device side is the same as that described in the first embodiment with reference to FIG. 7, an explanation thereof will be omitted.

After the above-described steps S3101 and S3102, steps S3111 to S3114, and further at step S3114*a*, it is determined whether or not replacement of an ink-supply unit has been detected. If it is determined that the replacement of the ink supply unit has been detected, the process proceeds to step S3114*b*, at which the amount of ink consumed in print-output of print data is added to the ink-consumption amount information since the detection of the replacement of the ink supply unit. Thereafter, the process returns to step S3111. On the other hand, if it is determined that replacement of an ink supply unit has not been detected, the process returns to step S3111.

Further, after steps S3115 and S3116, further at step S3116*a*, it is determined whether or not replacement of an ink supply unit has been detected. If it is determined that the replacement of the ink supply unit has been detected, the process proceeds to step S3116*b*, at which the amount of ink consumed in an operation other than print-output of print data is added to the ink-consumption amount information since the detection of the replacement of the ink supply unit. Thereafter, the process returns to step S3111. On the other hand, if it is determined that replacement of an ink supply unit has not been detected, the process returns to step S3111.

Further, after steps S3117 to S3120, if it is determined at step S3121' that a predetermined period has elapsed since the ink supply unit moved to the replacement position, the process proceeds to step S3121*b*, at which to start addition of ink-consumption amount information since detection of replacement of ink supply unit, the apparatus is set to a status indicating the fact that replacement of an ink supply unit has been detected.

The processing thereafter is as described above.

As described above, according to the present embodiment, in addition to the advantages obtained by the ninth embodiment, the ink consumption amount is managed by using two kinds of information, i.e., the ink-consumption amount information updated at each ink consumption, and the ink-consumption amount updated since detection of replacement of an ink supply unit. Accordingly, the ink-consumption amount information can be accurately updated by using, e.g., the ink-consumption amount information since detection of replacement of an ink supply unit, considering the amount of ink consumed during the period from user's replacement of an ink supply unit to the actual update of ink-consumption amount information managed by the printing apparatus.

<Twelfth Embodiment (FIGS. 23A–23B)>

Next, still another printing operation performed by using the inkjet printing apparatus described with reference to FIGS. 18 and 19 and the printhead described with reference to FIG. 2 will be described.

Further note that the ink-supply unit replacement check message used in this embodiment is the same as that described in FIGS. 8 and 9.

Figure 23A:
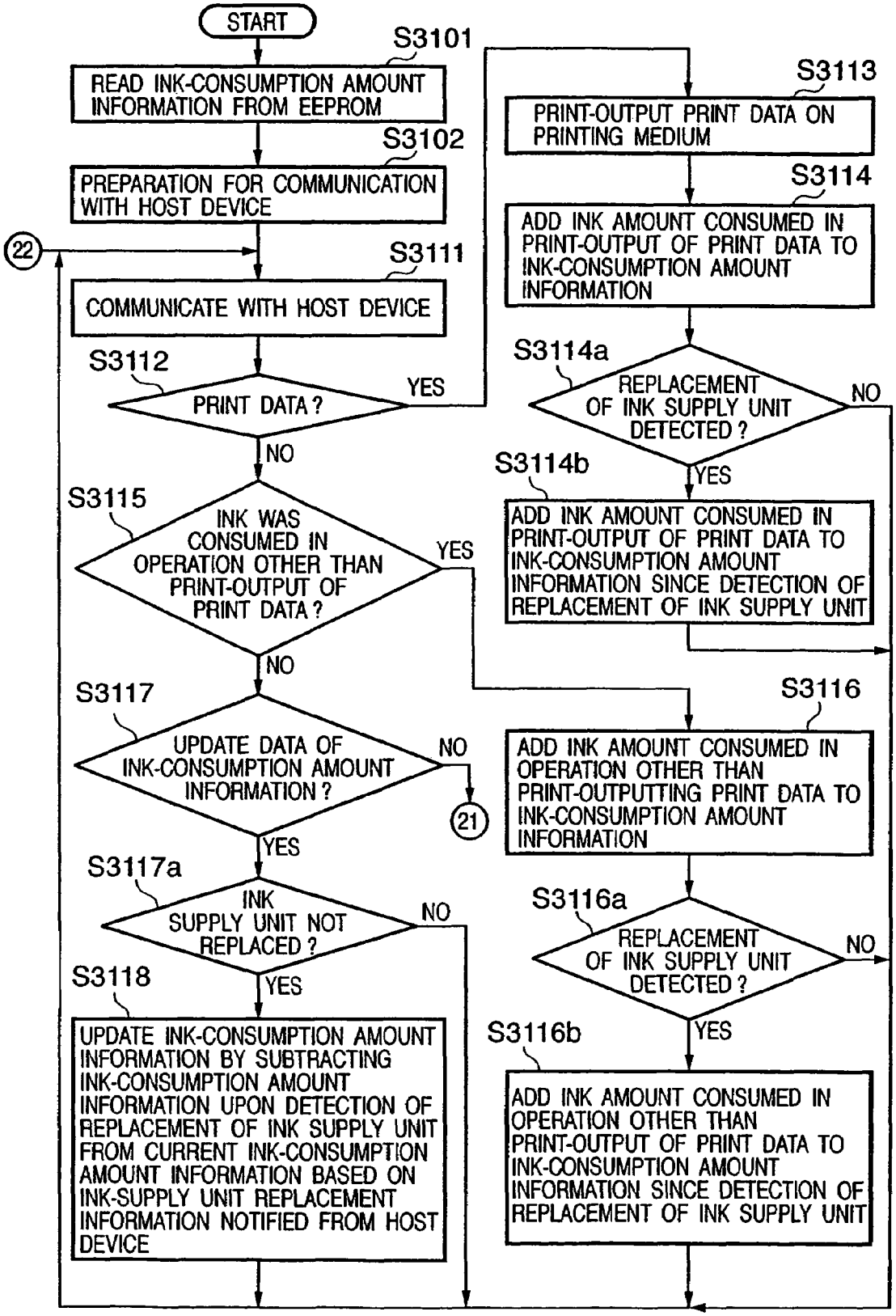
FIGS. 23A and 23B are flowcharts showing the operation of the printing apparatus according to a twelfth embodiment of the present invention.
Figure 23B:
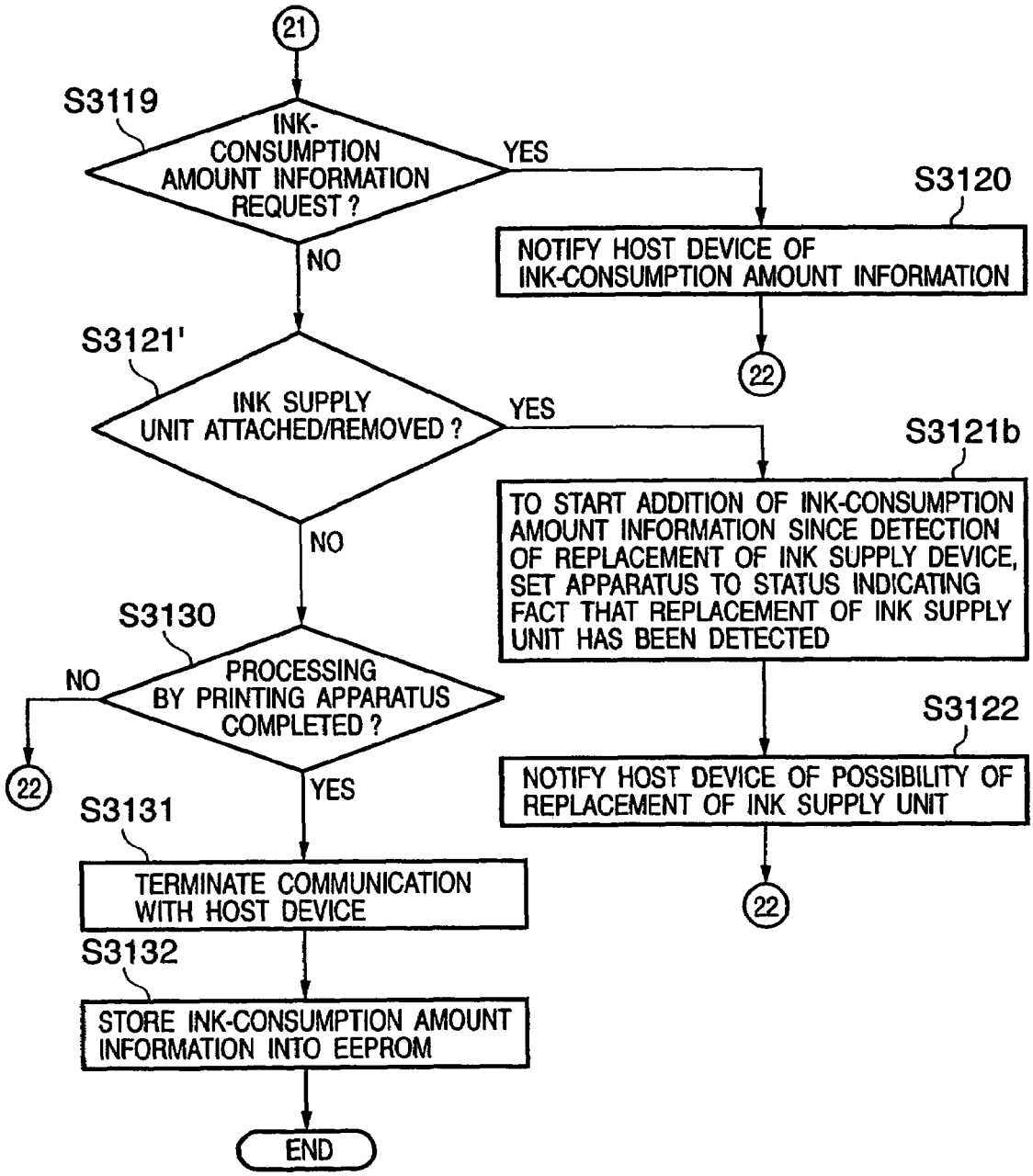

FIGS. 23A and 23B are flowcharts showing the operation of the printing apparatus according to a twelfth embodiment of the present invention. Note that in FIGS. 23A and 23B, process steps corresponding to those described in the above embodiment have the same step reference numerals and explanations thereof will not be repeated. Here only process steps characteristic of this embodiment will be described. Further, as the operation on the host device side is the same as that described in the second embodiment with reference to FIG. 11, an explanation thereof will be omitted.

In the processing according to the twelfth embodiment, step S3117*a* is added to the processing according to the eleventh embodiment described with reference to the flowchart of FIGS. 22A and 22B.

By the above-described steps S3101 and S3102, steps S3111 to S3114, step S3114*a*, step S3114*b*, step S3115, step S3116, step S3116*a*, step S3116*b*, and step S3117, and especially, if it is determined at step S3117 that the received data is update data of the ink-consumption amount information, the process proceeds to step S3117*a*, at which it is determined whether or not the content of the update data of the ink-consumption amount information indicates replacement of an ink supply unit. If it is determined that the content of the data does not indicate replacement of an ink supply unit, the process returns to step S3111 without updating the ink-consumption amount information.

On the other hand, if it is determined that the content of the data indicates replacement of an ink supply unit, the process proceeds to step S3118.

The processing thereafter is as described above.

As described above, according to the present embodiment, in addition to the advantages obtained by the eleventh embodiment, as the user can make a response indicating that no ink supply unit has been replaced according to the ink supply unit replacement checking message shown in FIG. 8 or FIG. 9, it can be determined in accordance with the response whether or not the replacement of an ink supply unit has occurred. By this arrangement, proper processing can be performed upon user's erroneous operation of the printing apparatus, e.g., removing the ink supply device and attaching it again.

Note that, in the description of the above embodiment, a liquid droplet discharged from the printhead is ink, and the liquid stored in the ink tank is also ink. However, the liquid stored in the ink tank is not limited to ink. For example, the ink tank may store a processed liquid to be discharged onto a print medium so as to improve fixability and water repellency of a printed image or to improve its image quality.

Each of the embodiments described above comprises means (e.g., an electrothermal transducer) for generating heat energy as energy utilized upon execution of ink discharge, and adopts the method which causes a change in the state of ink by the heat energy, among the ink-jet printing method. According to this printing method, a high-density, high-precision printing operation can be attained.

As the typical arrangement and principle of the ink-jet printing method, one practiced by use of the basic principle disclosed in, for example, U.S. Pat. Nos. 4,723,129 and 4,740,796 is preferable. The above method is applicable to either one of so-called an on-demand type and a continuous type. Particularly, in the case of the on-demand type, the method is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Publication Laid-Open No. 59-123670 which discloses the arrangement using a slot common to a plurality of electrothermal transducers as a discharge portion of the electrothermal transducers, or Japanese Patent Publication laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, the present invention may employ not only a cartridge type printhead, in which an ink tank is integrally arranged on the printhead itself, but also an exchangeable chip type printhead which can be electrically connected to the apparatus main unit and can receive ink from the apparatus main unit upon being mounted on the apparatus main unit.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet method, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling method is most effective for the above-mentioned inks.

In addition, the ink-jet printer of the present invention may be used in the form of a copying machine combined with a reader, and the like, or a facsimile apparatus having a transmission/reception function, in addition to an integrally-provided or stand-alone image output terminal of an information processing equipment such as a computer.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing by discharging ink supplied from a replaceable ink tank by a printhead on a printing medium, based on-print data received from a host, comprising:

scanning means for scanning a carriage to which said ink tank and said printhead are mounted;

storage means for storing ink-consumption amount information;

count means for counting a value representing a consumption amount of said ink;

update means for updating the ink-consumption amount information stored in said storage means based on the value counted by said count means;

carriage position discrimination means for discriminating whether or not said carriage stops moving at a predetermined position of a scanning oath and more than a predetermined period of time elapses at the predetermined position;

determination means for determining a possibility of replacement of said ink tank, based on a result of discrimination by said carriage position discrimination means;

storage control means for controlling storage of first consumption-amount information into said storage means upon determination by said determination means of the possibility of replacement of said ink tank;

notification means for notifying said host of a result of determination by said determination means of the possibility of replacement of said ink tank;

reception means for receiving from said host a user's confirmation as to whether or not said ink tank has been surely replaced, and for receiving from said host ink amount information on ink contained in an ink tank newly set by the replacement of said ink tank, as the result of notification by said notification means; and change means for changing the ink-consumption amount information obtained by said update means, based on the ink-consumption amount information updated by said update means upon reception by said reception means, on the first consumption-amount information stored in said storage means, and on the ink amount information received by said reception means.

2. The apparatus according to claim 1, wherein said carriage position discrimination means includes:

measurement means for measuring elapsed time since said ink tank moved to the predetermined position; and comparison means for comparing the elapsed time measured by said measurement means with a predetermined threshold value, and wherein said determination means determines the possibility of replacement of said ink tank based on the result of comparison by said comparison means.

3. The apparatus according to claim 1, wherein said host includes:

display means for displaying an ink-tank replacement check message on a display screen, based on the result of determination notified by said notification means;

receiving means for receiving confirmation of replacement of said ink tank from a user; and transmission means for transmitting to said apparatus the user's confirmation as to whether or not said ink tank has surely been replaced, and for transmitting to said apparatus the ink amount information on said ink contained in the ink tank newly set by the replacement of said ink tank, based on reception of the confirmation of replacement of said ink tank.

4. The apparatus according to claim 3, wherein said host further includes designation means for designating an amount of the ink contained in the ink tank newly set by the replacement of said ink tank.

5. The apparatus according to claim 3, wherein said display means is capable of displaying a message for checking to be sure that no ink tank has been replaced, and wherein said receiving means is capable of receiving confirmation that no ink tank has been replaced.

6. The apparatus according to claim 5, further comprising prevention means for preventing change of the ink-consumption amount information by said change means if said receiving means receives the confirmation that no ink tank has been replaced and it is confirmed via said reception means that no ink tank has been replaced.

7. The apparatus according to claim 1, wherein said count means includes:

first count means for counting ink consumption related to a printing operation based on the print data from said host; and second count means for counting the ink consumption not related to said printing operation.

8. The apparatus according to claim 7, further comprising:

presumption means for presuming that the replacement of said ink tank has been made upon acquisition of the result of determination by said determination means; and accumulation means for accumulating the ink consumption obtained from counting by said first or second count means since presumption of the replacement of said ink tank by said presumption means, as the ink consumption from the ink tank newly set by the replacement of said ink tank.

9. The apparatus according to claim 1, wherein said printhead is an inkjet printhead, and wherein said inkjet printhead has electrothermal transducers that generate thermal energy to be applied to said ink, so as to discharge said ink by utilizing the thermal energy.

10. An ink-consumption amount management method for a printing apparatus for performing printing by scanning a carriage to which a printhead and a replaceable ink tank, and discharging ink supplied from the replaceable ink tank by said printhead on a printing medium, based on print data received from a host, said method comprising:

a storage step of storing ink-consumption amount information into a storage medium;

a count step of counting a value representing a consumption amount of said ink;

an update step of updating the ink-consumption amount information stored in said storage medium based on the value counted at said count step;

a carriage position discrimination step of discriminating whether or not said carriage stops moving at a predetermined position of a scanning path and more than a predetermined period of time elapses at the predetermined position;

a determination step of determining a possibility of replacement of said ink tank, based on a result of discrimination at said carriage position discrimination step;

a storage control step of controlling storage of first consumption-amount information into said storage means upon determination of the possibility of replacement of said ink tank at said determination step;

a notification step of notifying said host of a result of determination of the possibility of replacement of said ink tank at said determination step;

a reception step of receiving from said host a user's confirmation as to whether or not said ink tank has been surely replaced, and of receiving from said host ink amount information on ink contained in an ink tank newly set by the replacement of said ink tank, as the result of notification at said notification step; and a change step of changing the ink-consumption amount information obtained at said update step, based on the ink-consumption amount information updated at said update step upon reception at said reception step, on the first consumption-amount information stored in said storage medium, and on the ink amount information received at said reception step.

* * * * *

UNITED STATES PATENT AND TRADEMARK OFFICE

CERTIFICATE OF CORRECTION

PATENT NO. : 7,001,006 B2 
APPLICATION NO. : 10/916595
DATED : February 21, 2006
INVENTOR(S) : Hiroshi Kanamaru It is certified that error appears in the above-identified patent and that said Letters Patent is hereby corrected as shown below:

Column 8
Line 54, “use” should read --user--.

Column 13
Line 9, “C” should be deleted.

Column 14
Line 7, “an if” should read --if an--.

Column 16
Line 56, “S102” should read --S3102--.

Column 19
Line 10, “removal/removal” should read --attachment/removal--.

Column 23
Line 42, “on-print” should read --on print--; and
Line 55, “oath” should read --path--.

Column 24
Line 29, “ink-tank” should read -- ink tank--.

Signed and Sealed this

Fourteenth Day of November, 2006

JON W. DUDAS
*Director of the United States Patent and Trademark Office*